US011132987B1

(12) United States Patent
Tang et al.

(10) Patent No.: US 11,132,987 B1
(45) Date of Patent: Sep. 28, 2021

(54) CHROMA DETECTION AMONG MUSIC, SPEECH, AND NOISE

(71) Applicant: Dialpad, Inc., San Francisco, CA (US)

(72) Inventors: Qian-Yu Tang, Milpitas, CA (US); John Rector, Oakland, CA (US)

(73) Assignee: DIALPAD, INC., San Francisco, CA (US)

( * ) Notice: Subject to any disclaimer, the term of this patent is extended or adjusted under 35 U.S.C. 154(b) by 0 days.

(21) Appl. No.: 17/030,136

(22) Filed: Sep. 23, 2020

Related U.S. Application Data

(63) Continuation of application No. 16/399,738, filed on Apr. 30, 2019, now Pat. No. 10,796,684.

(51) Int. Cl.
*G10L 25/81* (2013.01)
*G10K 11/178* (2006.01)

(52) U.S. Cl.
CPC ..... *G10K 11/17827* (2018.01); *G10L 25/81* (2013.01); *G10K 2210/108* (2013.01); *G10K 2210/3025* (2013.01)

(58) Field of Classification Search
CPC ... G06F 16/683; H04R 2225/41; G10L 25/78; G10L 25/81; G10L 19/26; G10L 15/20; G10L 17/02; G10L 17/26; G10L 21/02; G10L 21/0232; G10L 25/18; G10L 25/90; G10L 25/03; G10L 19/22; G10H 2210/046; G10H 2210/031
See application file for complete search history.

(56) References Cited

U.S. PATENT DOCUMENTS 6,785,645 B2 8/2004 Khalil et al.
7,386,217 B2 6/2008 Zhang
2012/0158401 A1 6/2012 Mazurenko et al.

OTHER PUBLICATIONS

"Series P: Telephone Transmission Quality, Telephone Installations, Local Line Networks", Telecommunication Standardization Sector of ITU, P.862, Feb. 2001, 30 pgs.
Bello, Juan Pablo et al., "A Tutorial on Onset Detection in Music Signals", IEEE Transactions on Speech and Audio Processing, Aug. 6, 2003, 13 pgs.
"Series G: Transmission Systems And Media, Digital Systems And Networks, International telephone connections and circuits—General definitions", Telecommunication Standardization Sector of ITU, G.107, Mar. 2005, 28 pgs.
Grosche, Peter et al., "Extracting Predominant Local Pulse Information From Music Recordings", IEEE Transactions on Audio, Speech, and Language Processing, Aug. 2011, 14 pgs.
Muller, Meinard, "Fundamentals of Music Processing", © Springer International Publishing Switzerland 2015, Chapter 6, pp. 303-346.

*Primary Examiner* — Kile O Blair
(74) *Attorney, Agent, or Firm* — Patent Law Works, LLP

(57) ABSTRACT

Audio data describing an audio signal may be received and used to determine a set of frames of the audio signal. One or more potential music events may be determined in the audio signal using a spectral analysis of the set of frames. The audio signal may be analyzed for one or more potential noise or tone events. One or more music states of the audio signal may be determined based on the one or more potential music events and a presence or absence of the one or more noise or tone events. Audio enhancement of the audio signal may be modified based on the one or more determined states of the audio signal.

30 Claims, 12 Drawing Sheets

| NOTE | $F_{pitch}(p)$ (HZ) | NOTE | $F_{pitch}(p)$ (HZ) | NOTE | $F_{pitch}(p)$ (HZ) | NOTE | $F_{pitch}(p)$ (HZ) |
|---|---|---|---|---|---|---|---|
| $C_1$ | 32.7 | $C_3$ | 130.81 | $C_5$ | 523.25 | $C_7$ | 2093 |
| $C^{\#}_1/D^b_1$ | 34.65 | $C^{\#}_3/D^b_3$ | 138.59 | $C^{\#}_5/D^b_5$ | 554.37 | $C^{\#}_7/D^b_7$ | 2217.46 |
| $D_1$ | 36.71 | $D_3$ | 146.83 | $D_5$ | 587.33 | $D_7$ | 2349.32 |
| $D^{\#}_1/E^b_1$ | 38.89 | $D^{\#}_3/E^b_3$ | 155.56 | $D^{\#}_5/E^b_5$ | 622.25 | $D^{\#}_7/E^b_7$ | 2489.02 |
| $E_1$ | 41.2 | $E_3$ | 164.81 | $E_5$ | 659.25 | $E_7$ | 2637.02 |
| $F_1$ | 43.65 | $F_3$ | 174.61 | $F_5$ | 698.46 | $F_7$ | 2793.83 |
| $F^{\#}_1/G^b_1$ | 46.25 | $F^{\#}_3/G^b_3$ | 185 | $F^{\#}_5/G^b_5$ | 739.99 | $F^{\#}_7/G^b_7$ | 2959.96 |
| $G_1$ | 49 | $G_3$ | 196 | $G_5$ | 783.99 | $G_7$ | 3135.96 |
| $G^{\#}_1/A^b_1$ | 51.91 | $G^{\#}_3/A^b_3$ | 207.65 | $G^{\#}_5/A^b_5$ | 830.61 | $G^{\#}_7/A^b_7$ | 3322.44 |
| $A_1$ | 55 | $A_3$ | 220 | $A_5$ | 880 | $A_7$ | 3520 |
| $A^{\#}_1/B^b_1$ | 58.27 | $A^{\#}_3/B^b_3$ | 233.08 | $A^{\#}_5/B^b_5$ | 932.33 | $A^{\#}_7/B^b_7$ | 3729.31 |
| $B_1$ | 61.74 | $B_3$ | 246.94 | $B_5$ | 987.77 | $B_7$ | 3951.07 |
| $C_2$ | 65.41 | $C_4$ | 261.63 | $C_6$ | 1046.5 | $C_8$ | 4186.01 |
| $C^{\#}_2/D^b_2$ | 69.3 | $C^{\#}_4/D^b_4$ | 277.18 | $C^{\#}_6/D^b_6$ | 1108.73 | $C^{\#}_8/D^b_8$ | 4434.92 |
| $D_2$ | 73.42 | $D_4$ | 293.66 | $D_6$ | 1174.66 | $D_8$ | 4698.63 |
| $D^{\#}_2/E^b_2$ | 77.78 | $D^{\#}_4/E^b_4$ | 311.13 | $D^{\#}_6/E^b_6$ | 1244.51 | $D^{\#}_8/E^b_8$ | 4978.03 |
| $E_2$ | 82.41 | $E_4$ | 329.63 | $E_6$ | 1318.51 | $E_8$ | 5274.04 |
| $F_2$ | 87.31 | $F_4$ | 349.23 | $F_6$ | 1396.91 | $F_8$ | 5587.65 |
| $F^{\#}_2/G^b_2$ | 92.5 | $F^{\#}_4/G^b_4$ | 369.99 | $F^{\#}_6/G^b_6$ | 1479.98 | $F^{\#}_8/G^b_8$ | 5919.91 |
| $G_2$ | 98 | $G_4$ | 392 | $G_6$ | 1567.98 | $G_8$ | 6271.93 |
| $G^{\#}_2/A^b_2$ | 103.83 | $G^{\#}_4/A^b_4$ | 415.3 | $G^{\#}_6/A^b_6$ | 1661.22 | $G^{\#}_8/A^b_8$ | 6644.88 |
| $A_2$ | 110 | $A_4$ | 440 | $A_6$ | 1760 | $A_8$ | 7040 |
| $A^{\#}_2/B^b_2$ | 116.54 | $A^{\#}_4/B^b_4$ | 466.16 | $A^{\#}_6/B^b_6$ | 1864.66 | $A^{\#}_8/B^b_8$ | 7458.62 |
| $B_2$ | 123.47 | $B_4$ | 493.88 | $B_6$ | 1975.53 | $B_8$ | 7902.13 |

Figure 8

907 909 911

| chroma | C0-B2 | octave 3 | octave 4 | octave 5 | octave 6 | octave 7 |
|---|---|---|---|---|---|---|
| C (0) | | | | 17(531.3) | 33(1031.3)<br>34(1062.5) | 66(2062.5)<br>67(2093.8)<br>68(2125.0) |
| C#(1) | | | 9(281.3), | 18(562.5), | 35(1093.8),<br>36(1125.0), | 69(2156.3)<br>-73(2281.3) |
| D (2) | | | | 19(593.8), | 37(1156.3),<br>38(1187.5), | 74(2312.5)<br>75(2343.8)<br>76(2375.0)<br>77(2406.3) |
| D#(3) | | 5(156.3) | 10(312.5) | 20(625.0) | 39(1218.8)<br>40(1250.0) | 78(2437.5)<br>79(2468.8)<br>80(2500.0)<br>81(2531.3) |
| E (4) | | | | 21(656.3) | 41(1281.3)<br>42(1312.5)<br>43(1343.8) | 82(2562.5)<br>-86(2687.5) |
| F (5) | | | 11(343.8) | 22(687.5)<br>23(718.8), | 44(1375.0)<br>45(1406.3)<br>46(1437.5) | 87(2718.8)<br>-92(2875.0) |
| F#(6) | 3( 93.8), | 6(187.5), | 12(375.0), | 24(750.0), | 47(1468.8)<br>48(1500.0) | 93(2906.3)<br>-97(3031.3) |
| G (7) | | | | 25(781.3), | 49(1531.3)<br>50(1562.5)<br>51(1593.8) | 98(3062.5)<br>-103(3218.8) |
| G#(8) | | | 13(406.3), | 26(812.5),<br>27(843.8), | 52(1625.0)<br>53(1656.3)<br>54(1687.5) | 104(3250.0)<br>-109(3406.3) |
| A (9) | | 7(218.8) | 14(437.5) | 28(875.0) | 55(1718.8)<br>56(1750.0)<br>57(1781.3) | 110(3437.5)<br>-115(3593.8) |
| A#(10) | | | 15(468.8), | 29(906.3),<br>30(937.5), | 58(1812.5)<br>59(1843.8)<br>60(1875.0)<br>61(1906.3) | 116(3625.0)<br>-122(3812.5) |
| B (11) | 1( 31.3)<br>2( 62.5)<br>4(125.0) | 8(250.0) | 16(500.0) | 31(968.8)<br>32(1000.0) | 62(1937.5)<br>63(1968.8)<br>64(2000.0)<br>65(2031.3) | 123(3843.8)<br>-128(4000.0) |

Figure 9

CHROMA DETECTION AMONG MUSIC, SPEECH, AND NOISE

RELATED APPLICATION

This application claims benefit as a continuation of U.S. application Ser. No. 16/399,738, filed on Apr. 30, 2019.

TECHNICAL FIELD

This disclosure pertains generally to computerized telephony and audio enhancement technology, and more specifically to automatic chroma detection among music, speech, and noise in communication systems.

BACKGROUND

Music is becoming more and more popular in telephony applications, such as music on hold, tele-conferencing, and video communications using smart phones, etc., particularly, as sampling rates increase. For instance, with increasing bandwidth and sampling rate in telephony applications, from the original narrow-band 8000 Hz, to wide-band 16000 Hz, and even to full-band 48000 Hz, high fidelity music is practicable. As a result, there is a trend to use more music in telephony applications.

Audio enhancement may be performed in telephony applications to improve voice quality by removing impairments such as noise and echo from an audio signal; however audio enhancement to voice or other sounds may negatively affect music. Accordingly, previous technologies fail to address the constraints presented by encountering music of varying genres among speech, noise, or tones, which may share the same bandwidth of frequencies with the music.

SUMMARY

Audio data describing an audio signal may be received and a set of frames of the audio signal may be determined using the audio data. The set of frames of the audio signal may be determined by performing a Fast Fourier Transform using a windowing function.

One or more potential music events may be identified based on a spectral analysis of the set of frames. Identifying the one or more potential music events based on the spectral analysis may include determining one or more chroma values for frequencies in the audio signal, estimating an energy for each of the one or more chroma values, identifying a chroma value of the one or more chroma values with a maximum energy in each of a plurality of octaves based on the estimated energies for the one or more chroma values, and determining a quantity of the plurality of octaves that includes a matching chroma value with the maximum energy. Identifying the one or more potential music events may include determining a chroma match counter value based on the quantity of the plurality of octaves that includes the matching chroma value with the maximum energy in the set of frames, and determining a potential music event based on the chroma match counter value.

One or more music states of the audio signal may be determined based on the one or more potential music events. In some instances, declaring that the audio signal includes music may be based on a transition of the one or more music states to a final state in a finite state machine. The transition of the one or more music states to the final state in the finite state machine may be based on a tone detection counter value accumulated over a subset of the set of frames satisfying a threshold, and the tone detection counter value may identify a tone event based on the spectral analysis. In some instances, the one or more music states of the audio signal may be determined based on a quantity of the one or more potential music events occurring within the set of frames. In some instances, a tone detection counter value may be set based on a quantity of chroma value changes over a defined time period, and music in the audio signal may be declared based on the one or more music states and the tone detection counter value.

Audio enhancement of the audio signal may be modified based on the one or more music states. Modifying the audio enhancement of the audio signal may comprise ceasing noise cancelation of the audio signal.

The features and advantages described in this summary and in the following detailed description are not all-inclusive, and particularly, many additional features and advantages will be apparent to one of ordinary skill in the relevant art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE DRAWINGS

FIG. 8 is a table of an example frequencies for an equal-tempered scale.

FIG. 9 is a table of an example frequency bin distribution based on chroma value.

Figure 1:
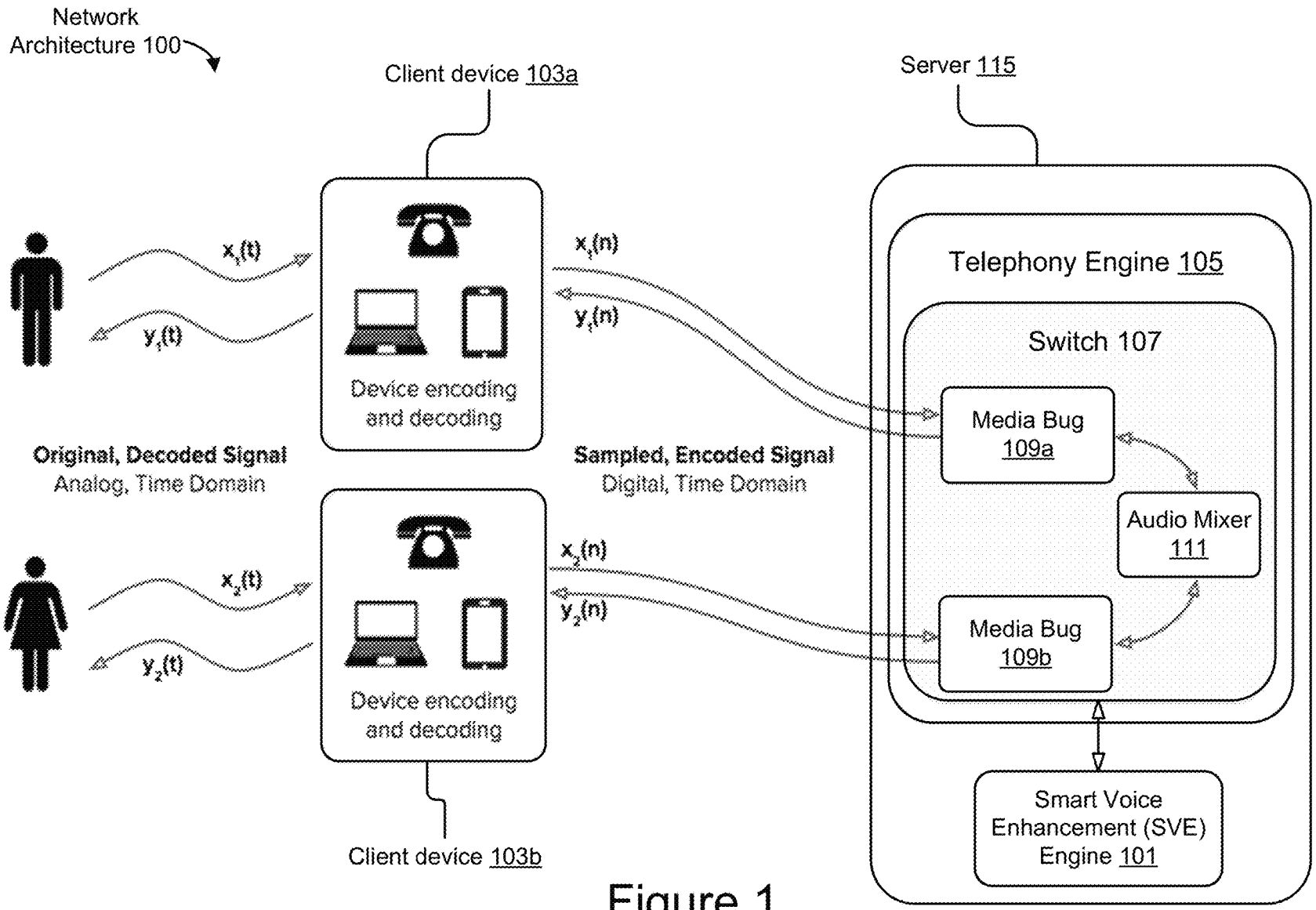
FIG. 1 is a block diagram of an exemplary network architecture in which audio signals may be analyzed.

The Figures depict various example implementations for purposes of illustration only. One skilled in the art will readily recognize from the following discussion that alternative examples of the structures and methods illustrated herein may be employed without departing from the principles described herein.

DETAILED DESCRIPTION

The technology described herein monitors the content and/or sound characteristics of audio signals, automatically detects music, and, in some instances, may adjust audio enhancement based on the detection of music.

For instance, the disclosure describes a system and method for chroma detection in a communication system. Smart voice enhancement may improve voice quality by removing impairments such as noise and echo in telephony applications. In some implementations, the technology may detect music in real-time and bypass performing certain audio enhancement (e.g., reducing noise and echo) on it in order to deliver music to end users, because, for example, noise cancellation may distort music. It should be noted that although the term smart "voice" enhancement is used herein, the technology may be used to process and/or enhance any type of audio.

The technology described herein detects music in real-time as soon as possible among music, speech, and noise whenever music packets show up in telephony applications. For instance, to avoid an unpleasant experience for an end user, music detection time should be as short (e.g., half a second to two seconds) as possible for telephony applications, and detection accuracy should be very high. However, music detection in real-time by a computing device (e.g., on a client or server side) is difficult, in part, because music, speech, noise, and noisy speech share a common frequency bandwidth. Additionally, there are many different kinds of music and assumptions that a particular kind of music will be encountered may lead to decreased performance for other music types in audio streams. For example, music genres span an enormous range of forms and styles, from popular, rock, and jazz music, to symphonies with a full orchestra. Further, musical instruments may include, among others, percussion (e.g., piano, drum, bell, etc.,), string (violin, viola, cello, guitar, etc.), woodwind (flute, clarinet, etc.), or brass (trombone, tuba, trumpet, etc.).

While previous technologies focused on heuristics for detecting specific songs, specific instruments, or specific genres of music, the technology described herein works across a variety of types of music, for example, by looking at underlying notes themselves. For example, the technology may perform music detection in real-time solely or partially based on processing incoming audio, which allows it to, for example, remove noise during speech without degrading music quality.

With reference to the figures, reference numbers may be used to refer to components found in any of the figures, regardless whether those reference numbers are shown in the figure being described. Further, where a reference number includes a letter referring to one of multiple similar components (e.g., component 000*a*, 000*b*, and 000*n*), the reference number may be used without the letter to refer to one or all of the similar components.

FIG. 1 is a block diagram of an exemplary network architecture 100 in which audio signals may be analyzed. The network architecture 100 may represent a telephony engine data path in which a smart voice enhancement engine 101 may be implemented. The illustrated network architecture may include one or more servers 115 and one or more endpoint client devices 103, which may be communicatively coupled via a network (not illustrated). In some implementations, the client devices 103*a* and 103*b* may be coupled via a network and may communicate via and/or receive services provided by the telephony engine 105 and/or a smart voice enhancement engine 101. It is to be understood that, in practice, orders of magnitude more endpoints (e.g., 103) and servers (e.g., 115) can be deployed.

A smart voice enhancement engine 101 is illustrated as residing on a server 115. It is to be understood that, in different implementations, the smart voice enhancement engine 101 can reside on different servers 115 or client devices 103, or be distributed between multiple computing systems in different ways, without departing from the scope of this disclosure.

Many different networking technologies can be used to provide connectivity from endpoint computer systems 103 to servers 115. Some examples include: LAN, WAN, and various wireless technologies. Endpoint systems 103 are able to access applications and/or data on server 115 using, for example, a web browser or other endpoint software (not shown). Endpoint client devices 103 can be in the form of, for example, desktop computers, laptop computers, smartphones, analog phones, or other communication devices capable of sending and/or receiving audio. Servers 115 can be in the form of, for example, rack mounted or tower computers or virtual servers implemented as software on a computing device, depending on the implementation.

Although FIG. 1 illustrates two endpoints 103 and one server 115 as an example, in practice many more (or fewer) devices can be deployed as noted above. In some implementations, the network is in the form of the internet, public switched telephone network (PSTN), or different communication system. Other networks or network-based environments can be used in addition to or instead of the internet in other implementations.

As illustrated in FIG. 1, a user may communicate with a client device 103*a* using speech or other audio, which may be received by the client device 103*a* as analog time-domain audio. In some implementations, the client device 103*a* may transmit the audio to the server 115 in a digital time-domain audio signal, although other implementations are possible. For instance, the telephony engine 105 may receive the audio signal from the client device 103*a* and, using a switch 107 may relay the audio to a second client device 103*b*, which may convert the audio signal to audio using an output device. It should be noted that the telephony engine 105 may enable two way communication between the client devices 103.

The telephony engine 105 may include a switch 107 and, in some implementations, a smart voice enhancement engine 101. In some implementations, the switch 107 may include an application server that enables real-time communication of audio and/or video using telecommunications and/or Voice over Internet Protocol (VoIP), for example. The switch 107 may run one or more media bugs 109*a* and 109*b*, an audio mixer 111, and, in some instances, a smart voice enhancement engine 101 or components thereof.

Figure 3:
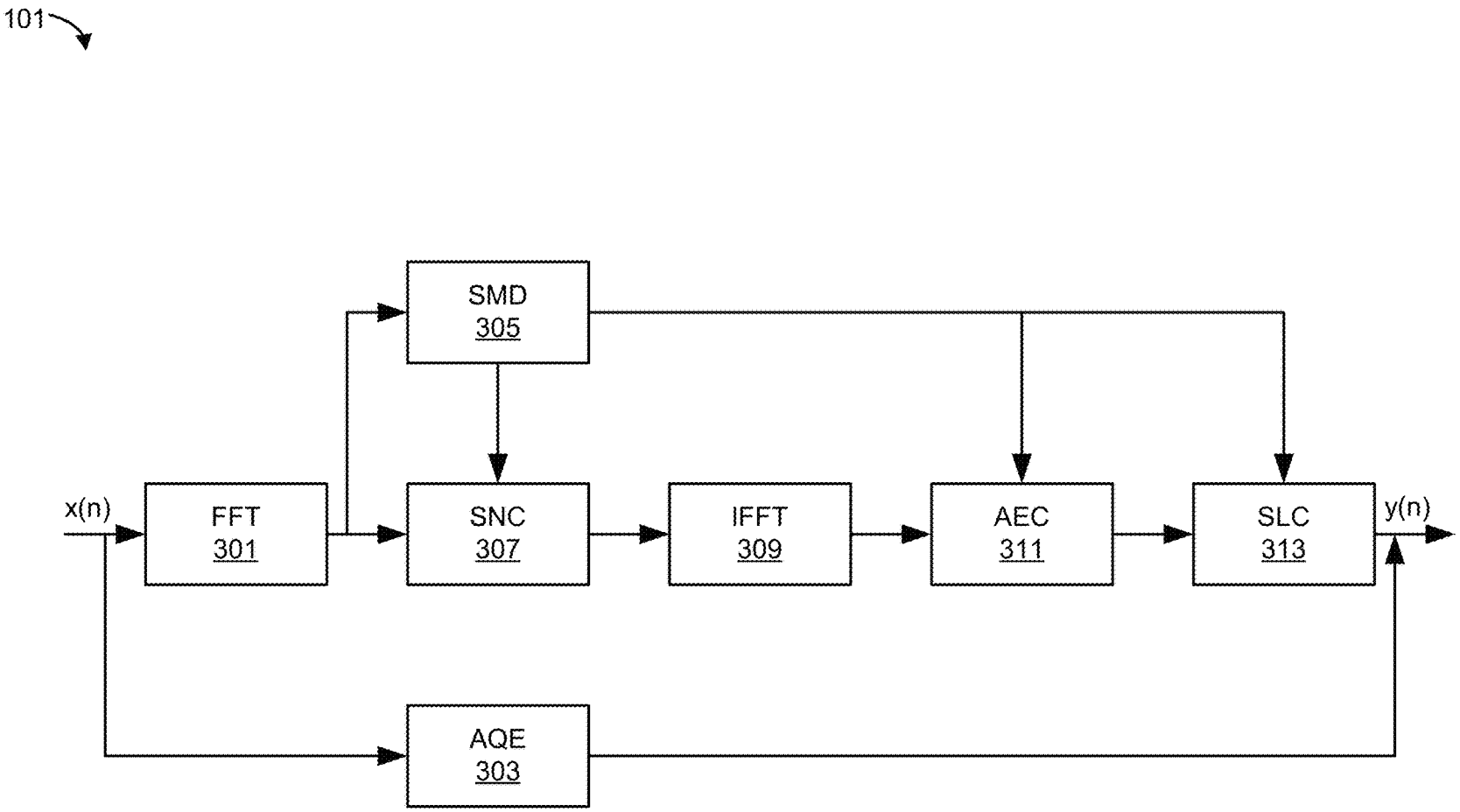
FIG. 3 is a block diagram of a smart voice enhancement engine.

In some implementations, a media bug 109 may include a dynamic library that provides an interface between one or more of the client devices 103, the smart voice enhancement engine 101, the audio mixer 111, the switch 107, and one or more other components of the telephony engine 105, such as a management interface (not shown). The audio mixer 111 may adjust volume levels, tones, or other elements of an audio signal, or perform other operations, depending on the implementation. The management interface may provide configuration and parameter setup for the modules smart voice enhancement engine 101, such as are shown in FIG. 3.

In some implementations, the smart voice enhancement engine 101 may include a library implemented on top of the switch 107 platform, but independent of the switch 107 as a stand-alone library. The smart voice enhancement engine 101 may operate on the server 115, although it is possible for it to operate on one or more of the client devices 103 without departing from the scope of this disclosure. The smart voice enhancement engine 101 may improve voice quality in a communication system by removing impairments such as noise and echo in telephony applications. For instance, as described in further detail in reference to FIGS. 4-7C, the smart voice enhancement engine 101 may detect music and bypass it in order to deliver unmodified music (or music modified differently than speech, etc.) to end users to avoid degradation of the music, which may be caused by voice enhancement processing, such as noise cancellation.

One or more of the components of the telephony engine 105 (e.g., the switch 107, media bug 109, audio mixer 111, or smart voice enhancement engine 101) may include software including logic executable by a processor to perform their respective acts, although the component may be implemented in hardware (e.g., one or more application specific integrated circuits (ASICs) coupled to a bus for cooperation and communication with the other components of the telephony engine 105 and/or network architecture 100; sets of instructions stored in one or more discrete memory devices (e.g., a PROM, FPROM, ROM) that are coupled to a bus for cooperation and communication with the other components of the system; a combination thereof; etc.).

Figure 2:
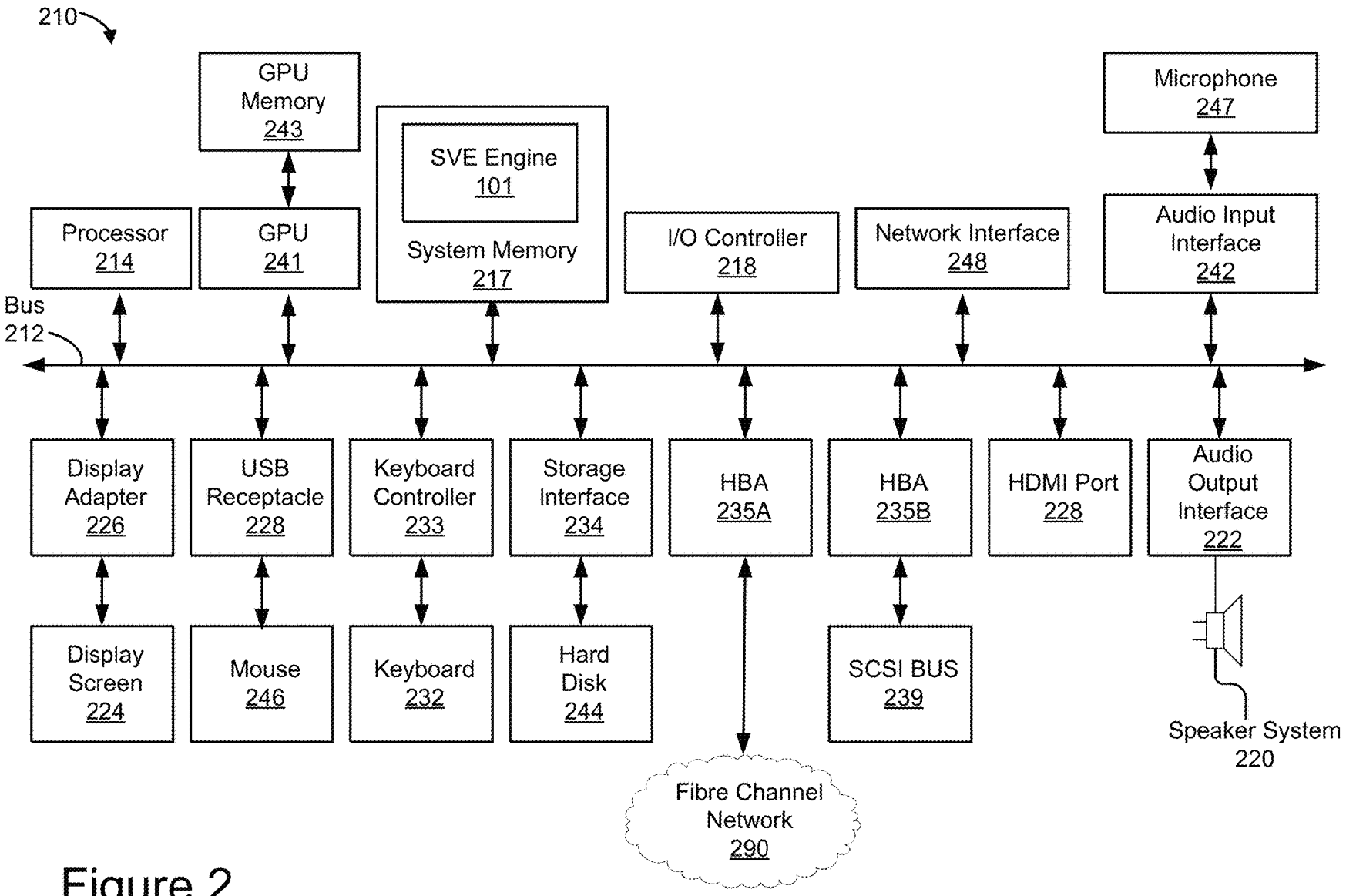
FIG. 2 is a block diagram of a computer system suitable for implementing a smart voice enhancement and music detection system.

FIG. 2 is a block diagram of a computer system 210 suitable for implementing a smart sound enhancement and music detection system. For instance, the computer system 210 may represent a server 115, which may execute the operations of the smart voice enhancement engine 101. Endpoints 103 and servers 115 can be implemented in the form of such computer systems 210. As illustrated, one component of the computer system 210 is a bus 212. The bus 212 communicatively couples other components of the computer system 210, such as at least one processor 214, system memory 217 (e.g., random access memory (RAM), read-only memory (ROM), flash memory), a graphics processing unit (GPU) 241, GPU memory 243, an input/output (I/O) controller 218, an audio input interface 242 communicatively coupled to an audio input device such as a microphone 247, an audio output interface 222 communicatively coupled to an audio output device such as a speaker 220, a display adapter 226 communicatively coupled to a video output device such as a display screen 224, one or more interfaces such as Universal Serial Bus (USB) ports 228, High-Definition Multimedia Interface (HDMI) ports 230, serial ports (not illustrated), etc., a keyboard controller 233 communicatively coupled to a keyboard 232, a storage interface 234 communicatively coupled to one or more hard disk(s) 244 (or other form(s) of storage media), a host bus adapter (HBA) interface card 235A configured to connect with a Fiber Channel (FC) or other network 290, an HBA interface card 235B configured to connect to a SCSI bus 239, a mouse 246 (or other pointing device) coupled to the bus 212, e.g., via a USB port 228, and one or more wired and/or wireless network interface(s) 248 coupled, e.g., directly to bus 212.

Other components (not illustrated) may be connected in a similar manner (e.g., document scanners, digital cameras, printers, etc.). Conversely, all of the components illustrated in FIG. 2 need not be present (e.g., smartphones, tablets, and some servers typically do not have external keyboards 242 or external pointing devices 246, although various external components can be coupled to mobile computing devices via, e.g., USB ports 228). In different implementations the various components can be interconnected in different ways from that shown in FIG. 2.

The bus 212 allows data communication between the processor 214 and system memory 217, which, as noted above may include ROM and/or flash memory as well as RAM. The RAM is typically the main memory into which the operating system and application programs are loaded. The ROM and/or flash memory can contain, among other code, the Basic Input-Output system (BIOS) which controls certain basic hardware operations. Application programs can be stored on a local computer readable medium (e.g., hard disk 244, solid state drive, flash memory) and loaded into system memory 217 and executed by the processor 214. Application programs can also be loaded into system memory 217 from a remote location (i.e., a remotely located computer system 210), for example via the network interface 248. In FIG. 2, the smart voice enhancement engine 101 is illustrated as residing in system memory 217. The workings of the smart voice enhancement engine 101 are explained in greater detail below in conjunction with FIGS. 3-9.

The storage interface 234 is coupled to one or more hard disks 244 (and/or other standard storage media). The hard disk(s) 244 may be a part of computer system 210, or may be physically separate and accessed through other interface systems.

The network interface 248 can be directly or indirectly communicatively coupled to a network such as the Internet, a PSTN, etc. Such coupling can be wired or wireless.

FIG. 3 illustrates an example smart voice enhancement engine 101. As described above, the functionalities of the smart voice enhancement engine 101 can reside on specific computers 210 (endpoints 103, servers 105) or be otherwise distributed between multiple computer systems 210, including within a cloud-based computing environment in which the functionality of the smart voice enhancement engine 101 is provided as a service over a network. It is to be understood that although the smart voice enhancement engine 101 is illustrated in FIG. 3 as single entity, the illustrated smart voice enhancement engine 101 represents a collection of functionalities, which can be instantiated as a single or multiple modules as desired (an instantiation of an example multiple module smart voice enhancement engine 101 is illustrated in FIG. 3). It is to be understood that the modules of the smart voice enhancement engine 101 can be instantiated (for example as object code or executable images) within the system memory 217 (e.g., RAM, ROM, flash memory) (and/or the GPU memory 243) of any computer system 210, such that when the processor(s) 214 (and/or the GPU 241) of the computer system 210 processes a module, the computer system 210 executes the associated functionality. In some implementations, the GPU 241 can be utilized for some or all of the processing of given modules of the smart voice enhancement engine 101. In different implementations, the functionality of some or all of the modules of the smart voice enhancement engine 101 can utilize the CPU(s) 214, the GPU 241, or any combination thereof, as well as system memory 217, GPU memory 243, or any combination thereof as desired.

As used herein, the terms "computer system," "computer," "endpoint," "endpoint computer," "server," "server computer" and "computing device" mean one or more computers configured and/or programmed to execute the described functionality. Additionally, program code to implement the functionalities of the smart voice enhancement engine 101 can be stored on computer-readable storage media. Any form of tangible computer readable storage medium can be used in this context, such as magnetic, optical or solid state storage media. As used herein, the term "computer readable storage medium" does not mean an electrical signal separate from an underlying physical medium.

The smart voice enhancement engine 101 may use speech signal processing algorithms to enhance voice quality for VoIP, wireless, and PSTN telephony applications. As shown in the example illustrated in FIG. 3, the smart voice enhancement engine 101 may include a Fast Fourier Transform (FFT) module 301, smart noise cancellation (SNC) module 307, inverse Fast Fourier Transform (IFFT) module 309, acoustic echo cancellation (AEC) module 311, smart level control (SLC) module 313, audio quality evaluation (AQE) module 303, and/or a smart music detection (SMD) module 305. In some implementations, although not illustrated in FIG. 3, the smart voice enhancement engine 101 may include functionality instantiating a voice activity detection algorithm (not shown), which may be incorporated or communicatively coupled with the smart music detection module 305.

Depending on the implementation, the FFT module 301 may convert an original time domain signal {x(n)} to frequency domain. A voice activity detection algorithm may operate in the frequency domain, which employs the fact that the frequency spectral for noise tends to be flat. Similar to voice activity detection algorithm, the smart music detection module 305 may operate in the frequency domain. The other modules (e.g., 307, 309, 311, or 313) may use the output of the smart music detection module to identify music, speech, or noise.

The SNC module 307 may remove ambient noise in frequency domain, so that the listener feels much more comfortable when listening to the speech with the noise removed. The IFFT module 309 may convert the frequency domain signal back to time domain by using the Inverse Fast Fourier Transform. The AEC 311 and SLC 313 may operate in the time domain to cancel acoustic eco and control audio volume levels, respectively. The output audio signal after smart voice enhancement processing is illustrated as {(n)}.

The AQE module 303 may use objective voice quality measurement algorithms to monitor smart voice enhancement for the audio signals before and after smart voice enhancement. In some implementations, the AQE module 303 may use ITU (International Telecommunications Union) standards for quality assessment, such as a G.107 E-model and/or a Perceptual Evaluation of Speech Quality (PESQ) test(s) to monitor quality of the audio signal. For example, the AQE module 303 may compare speech output in the outgoing audio signal with original clean audio in the incoming audio signal in order to get a mean opinion score (MOS). In some implementations, the G.107 E-model in the AQE module 303 may provide real-time and non-intrusive voice quality measurement, for example, in terms of the MOS value for each call. The MOS may represent a score of ratings gathered in a quality evaluation test, which may be manually or algorithmically performed.

The smart music detection module 305 may perform some or all of the operations described in reference to FIGS. 4-7C for detecting music, noise, or tone events. For instance, the smart music detection module 305 may perform energy evaluations on frequencies or groups of frequencies, in an equal-tempered scale, track frames, music events, noise events, tone events, and music states using various counters, as described in further detail in reference to FIGS. 4-7C.

For example, the smart music detection module 305 may increase a chroma consecutive match counter by one count if two or more octaves (e.g., among octaves 4-9) have the same chroma value with a maximum energy (also referred to as a peak chroma value), but may reset the counter to zero if one or fewer octaves have the same peak chroma value. Note that a chroma value may represent a note, frequency, or frequency range in a particular octave, as described in further detail below.

In some implementations, if chroma shows up in plural P consecutive frames consistently (e.g., a chroma shows up in a given percentage of a consecutive number of frames, such as 8 out of 10 consecutive frames), then a music event may be declared. Since the peak note in each octave for speech and noise normally shows a random pattern, the false detection probability of such a music event rather than speech or noise may be as small as one ten-millionth of a percent, depending on the circumstances. In some implementations, the smart music detection module 305 may also detect one or more noise or tone events during music detection based on spectral analysis of frames of the audio signal in order to rule out a false positive.

The smart music detection module 305 may include a finite state machine to further increase the music detection accuracy in the context of music, speech, and noise. One or more potential music events may be combined to form a music state of the finite state machine. In some implementations, detection of noise or a tone may reset a music state of the finite state machine. With increasing music events and satisfaction of other conditions, the finite state machine may move from state to state until a final state is reached, based upon which, the smart music detection module 305 may declare that music is present in an audio signal.

It should be noted that the smart music detection module 305 may include sub-components, algorithms, or routines, for example, which may perform one or more of the operations described in reference to the smart music detection module 305.

Figure 4:
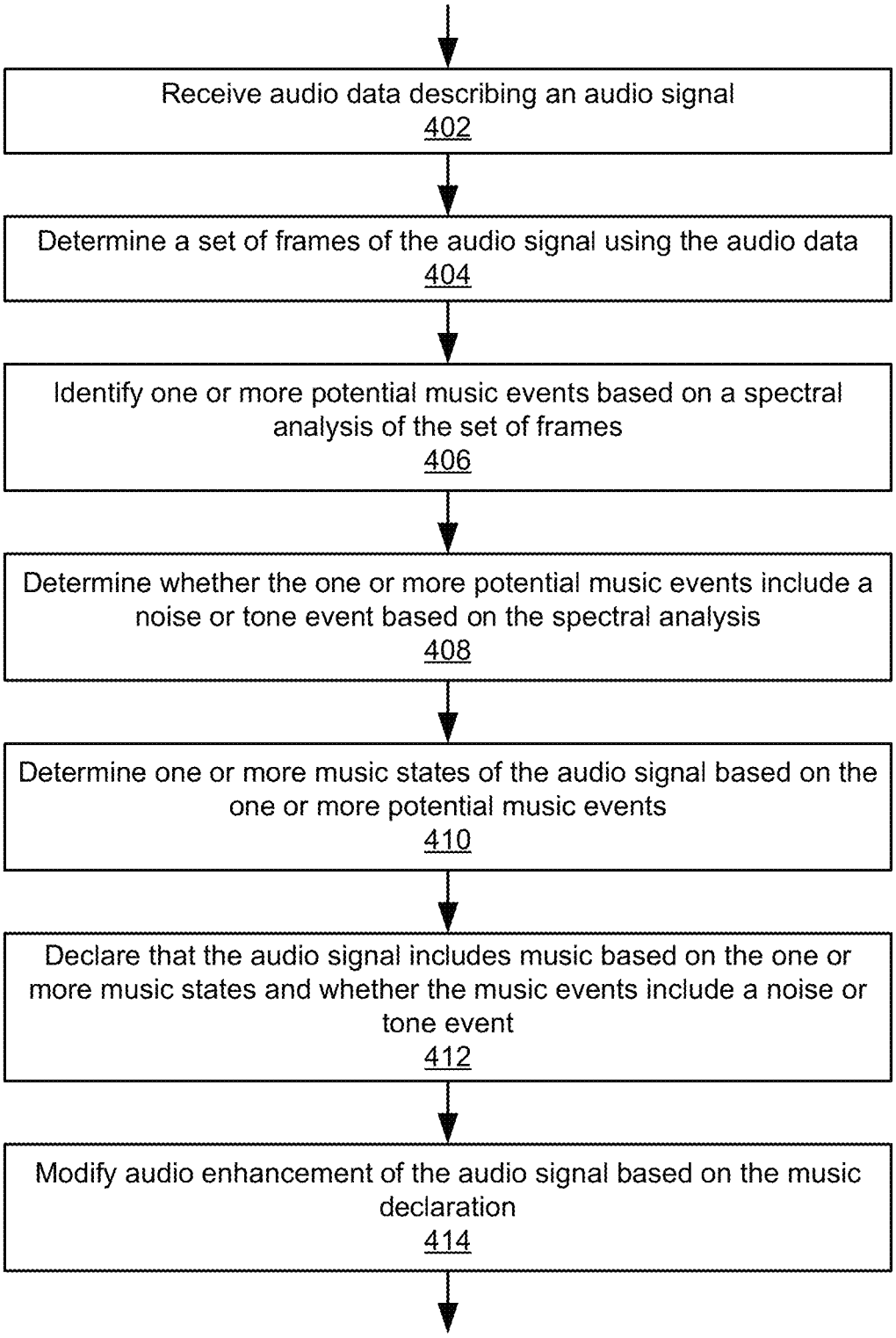
FIG. 4 is a flowchart of an example method for smart enhancement of an audio signal, according to some implementations.

FIG. 4 is a flowchart of an example method for smart enhancement of an audio signal. In some implementations, at 402, the smart voice enhancement engine 101 may receive audio data describing an audio signal. For example, the smart music detection module 305 may receive an audio speech signal at a speech decoder, as illustrated in FIG. 1. The audio data may be in any audio format that may be processed by the smart music detection module 305. For example, the audio data may be a digital file representing a time-domain based signal.

At 404, the smart voice enhancement engine 101 may determine a set of frames of the audio signal using the audio data. For instance, the smart voice enhancement engine 101 (e.g., the FTT module 301) may perform Fast Fourier Transform framing with a windowing function.

For example, the discrete Fourier transform (DFT) of the time-domain signal {x(n)} is given as follows:

$$X(m,k)=\sum_{n=0}^{N-1}x(n+mH)w(n)e^{-j2\pi kn/N},\ 0\le k\le N-1, \tag{1}$$

where m is the frame number, k is the frequency bin, H is the frame hop size, N is the fast Fourier transform (FFT) size, and w(n) is the window function, n∈[0,N−1]. Example window functions that may be used may include rectangular, Bartlett, Hanning, Hamming, Blackman, and Kaiser windows, etc.

Similarly, it should be noted that, for use by the IFFT module 309 (or another component of the smart voice enhancement engine 101), the inverse DFT is given by $$x(n+mH)=\frac{1}{N}\sum_{k=0}^{N-1}X(m,k)e^{j2\pi kn/N}\ 0\le n\le N-1, \tag{2}$$

for the m-th frame.

One music symbolic representation is the Musical Instrument Digital Interface (MIDI) standard. Using MIDI note numbers, the equal-tempered scale gives the center frequency (Hz):

$$F_{pitch}(p)=440*2^{(p-69)/12},\ 0\le p\le 127, \tag{3}$$

for each pitch P∈[0,127]. For example, for the reference pitch number p=69 corresponding to note A4, the frequency $F_{pitch}(p)$=440 Hz. For other notes from C1-B8, the corresponding frequencies can be found in the table illustrated in FIG. 8, which illustrates example frequencies for an equal-tempered scale with A4=440 Hz. For pitch p, the bandwidth may be defined as $$BW(p)=F_{pitch}(p+0.5)-F_{pitch}(p-0.5),\ 0\le p\le 127. \tag{4}$$

From the relationship (4), the bandwidth BW(p) may be monotonically increasing with respect to the pitch p.

For each octave, there are twelve different notes. For example, each note may have a chroma value, ranging from [0, 11], where note C has chroma value 0 and note B has chroma value 11 respectively. In some instances, the note center frequency follows an exponential formula as in relationship (3), so the note with same chroma value in octave i+1 has double frequency as that in octave i, for 0≤i≤9.

In the DFT formula (1), frequency bin k corresponds to the physical frequency $$F_{coef}(k) = k^{*}\frac{F_s}{N},\ 0 \le k \le N, \tag{5}$$

in Hz, where F is the sampling frequency in Hz, and N is the FFT size. It should be noted that, as illustrated in relationship (5), the frequencies corresponding to FFT bins may be linearly distributed, whereas the frequencies corresponding to pitches may follow logarithmic perception from (3). For given pitch p, within its bandwidth BW(p), there may be multiple FFT bins, or single, or none at all. For pitch p, the smart music detection module 305 may define the FFT bin set as $$BIN(p)=\{k:F_{pitch}(p-0.5)\le F_{coef}(k)<F_{pitch}(p+0.5)\},\quad 0\le p\le 127. \tag{6}$$

For m-th frame, the pitch p has a log-frequency (LF) spectrogram corresponding to:

$$Z_{LF}(m,\ p) = \sum_{k\in BIN(p)} |X(m,\ k)|^2,\ 0 \le p \le 127.$$

For chroma c∈[0,1 I], the smart music detection module 305 may define the chromagram as follows:

$$C(m,\ c) = \sum_{\{p:\ p\ mod 12=c\}} Z_{LF}(m,\ p). \tag{8}$$

In a public switched telephone network (PSTN), the sampling rate may be fixed at $F_s$=8000 Hz, resulting in maximum speech bandwidth 4000 Hz, based on sampling theorem, which corresponds to the narrow-band case. This sampling rate may also be used in voice-over-internet (VOIP) and wireless cellular networks, for example, when the following speech codecs are used: G. 711 (a-law and μ-law), G.729, G.723, G.726, AMR, GSM, GSM-HR, GSM-FR, etc. In some instances, a wide-band with sampling rate $F_s$=16000 Hz and an efficient signal bandwidth of 8000 Hz may be used. A wide band coder may include AMR-WB and G.722. Similarly, a full-band sampling rate $F_s$=48000 with efficient signal bandwidth up to 24000 Hz, including Opus codec, may be used.

In the narrow band case, N=256 points and the FFT has minimum granularity 8000/256=31.25 Hz based on (5) for the N bins, which may also be true for the wide band case with N=512. In the full band case, N=1024 points and the FFT has minimum granularity 48000/1024=46.875 Hz.

Although it should be noted that other implementations are possible, for clarity of description, this disclosure is described using the narrow band case, although wide band or full bands may also be used. Based on the relationships (3)-(6), for the FFT size N=256, the frequency bins corresponding to each octave may be distributed as illustrated in FIG. 9, which illustrates an example frequency bin distribution based on chroma value. In the table in FIG. 9, the FFT bin is followed by the physical frequency in parentheses. To make the table in FIG. 9 more compact, the last column 911 may list only the lowest and the highest FFT bins, although it should be noted that additional bins may exist. The table illustrated in FIG. 9 may be programmed as arrays in C language to save CPU usage, although other implementations are possible.

The last three columns 907, 909, and 911 in the table in FIG. 9, corresponding to octaves 5-7, may be used by the smart music detection module 305 during chroma detection, since each chroma value has at least one FFT bin, whereas only a portion of the chroma values in octaves 0-4 have FFT bins. It should be noted if N=512 is used, the FFT minimum granularity changes to 8000512=15.625 Hz, in which instance, each chroma value in octave 4 contains at least one FFT bin and twelve chroma values in octave 4 can be detected. It should be noted that, in general, more FFT bins give better frequency granularity, and thus improve the detection time of the chroma detection algorithm.

At 406, the smart music detection module 305 may identify one or more potential music events based on a spectral analysis of the set of frames. For instance, the smart music detection module 305 may perform spectral analysis per frame in the incoming audio signal and, based on the analysis of a set of frames, may construct one or more music events. For example, the smart music detection module 305 may determine a music event based on consecutive P frames where chroma shows up consistently (e.g., a threshold quantity in a given set) and may update chroma detection statistics in a storage device.

Performing spectral analysis for the incoming audio signal may include calculating a signal/spectral energy in a frequency domain per note in each octave (e.g., of octaves 4-9) based on frequencies for an equal-tempered scale. The smart music detection module 305 may also calculate energy per octave for octaves 0-9.

In some implementations, the smart music detection module 305 may find a peak note with maximum energy in each octave in the linear domain, as well as that with maximum averaged energy in decibel (dB) domain. If the smart music detection module 305 determines that, within a small dB range, there are too many chroma values (e.g., four to ten values) achieving the same maximum energy value, then the smart music detection module 305 may determine that the frame is a noise frame and no music is present and, depending on the implementation, may reset the state of the finite state machine to the initial state $S_0$. These and other operations are described in further detail at least in reference to FIGS. 5A-6, for example.

At 408, the smart music detection module 305 may determine whether the one or more potential music events include a noise or tone event based on the spectral analysis. For example, a fixed-spectral pattern, such as a tone, noise, tone-like noise, sirens, etc., may be differentiated from a music event by implementing a tone detection algorithm.

In some implementations, the smart music detection module 305 may compare power spectral density per critical band with a previous frame and, within a small dB range, if the power spectral density does not change too often (e.g., a quantity of changes falls below a defined threshold, such as eight times in consecutive ten frames), then the smart music detection module 305 may determine that no music is present. Similarly, the smart music detection module 305 may sum power spectral density differences over the critical bands, and may determine, based on frequent (e.g., beyond a defined threshold, such as five times in a consecutive ten frames) peak note changes, that fixed-pattern noise is present. These and other operations are described in further detail at least in reference to FIGS. 7A-7C, for example.

At 410, the smart music detection module 305 may determine one or more music states of the audio signal based on the one or more potential music events. For example, a finite state machine may be implemented for chroma detection to increase the music detection accuracy in the context of music, speech, and noise. The finite state machine may require multiple instances of music event detection (e.g., five to twenty times), within specified time duration, in order to declare the final music detection.

For instance, the finite state machine may include plural R music states. The finite state machine may transition between states based on the quantity of music events detected and, in some implementations, based on other conditions, as described in further detail below. Additionally, the smart music detection module 305 may reset or reduce the state of the finite state machine based on other conditions, such as an insufficient consistency or frequency of peak chroma values or detection of tone or noise events. For instance, the smart music detection module 305 may reset the finite state machine state to the initial state S if Q music events are not found within specified plural L frames in any state or may move the finite state machine to the next state otherwise.

In some instances, the smart music detection module 305 may reduce or reset the finite state machine to the original state Sif speech or noise is identified. In some implementations, the smart music detection module 305 may accumulate a chroma match counter, total note change counter, etc., across frames in the finite state machine. For example, in some implementations the total note changes in the finite state machine may not exceed a boundary threshold in order to declare the final music detection, so that noise is excluded from a potential music event. Similarly, tone or tone-like events are differentiated from a music event. The smart music detection module 305 may also accumulate a tone detection counter from the potential music events in the finite state machine. If the total tone detection counter exceeds a boundary threshold, the smart music detection module 305 may declare a tone event and, in some instances, reset the state of the finite state machine based on the tone event. The finite state machine and transitions between the states of the finite state machine based on music events, tones, and noise are described in further detail below in reference to FIGS. 5A-7C.

At 412, the smart music detection module 305 may declare that the audio signal includes music based on the one or more music states and whether the music events include a noise or tone event. For example, the smart music detection module 305 may declare music in the audio signal based on a transition to a final state of the finite state machine, such as is described in further detail in reference to FIG. 5B.

At 414, the smart voice enhancement engine 101 may modify audio enhancement of the audio signal based on the music declaration and/or music states. For example, if music is detected, the smart music detection module 305 may transmit a signal indicating the music to the SNC module 307, AEC module 311, or SLC module 313, which may cease or modify audio enhancement for a duration of the detected music. For example, smart voice enhancement engine 101 may cease noise cancelation of the audio signal during the frames that include detected music.

Figure 5A:
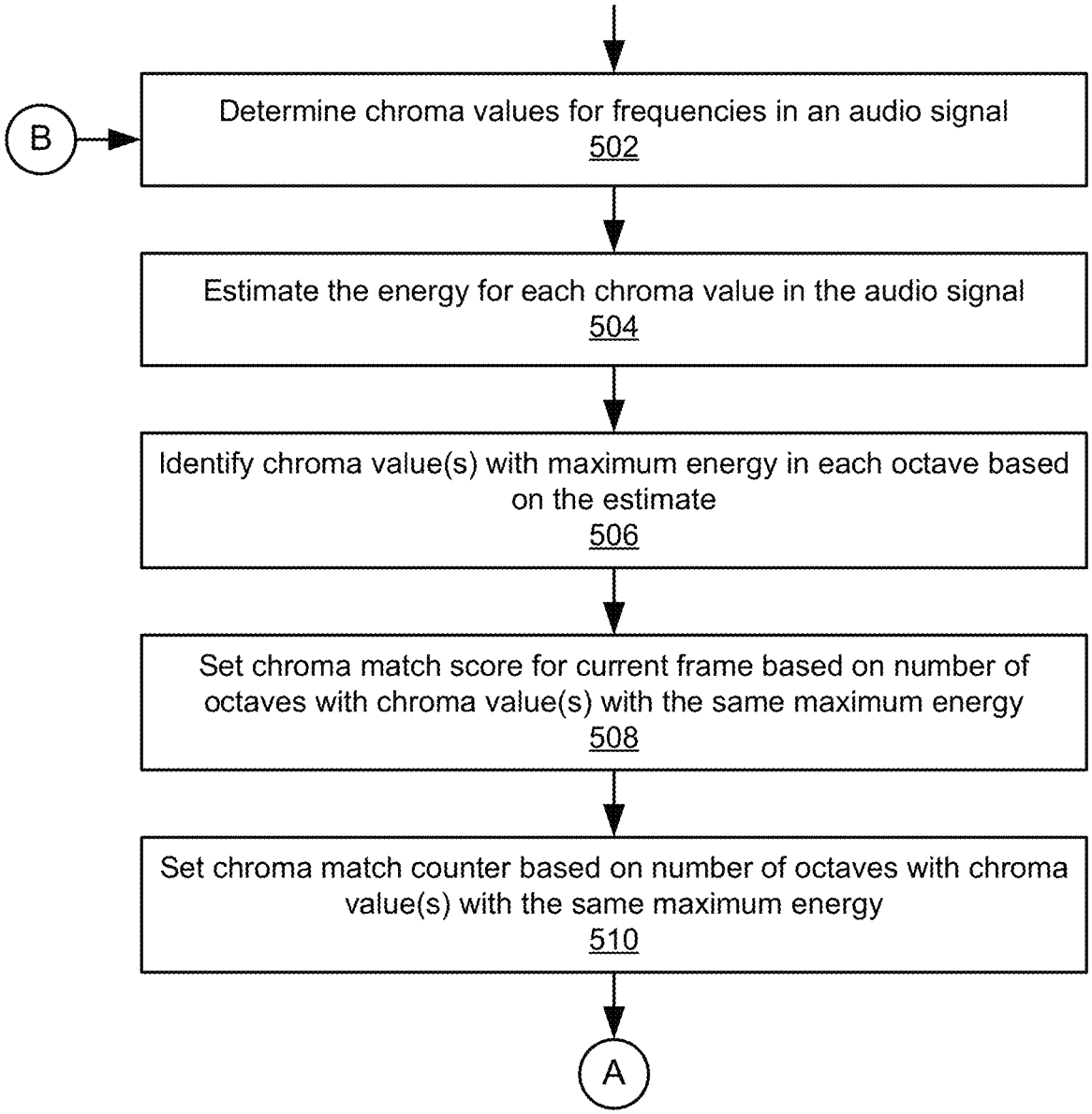
FIGS. 5A and 5B are flowcharts of an example method for detecting music in an audio signal.
Figure 5B:
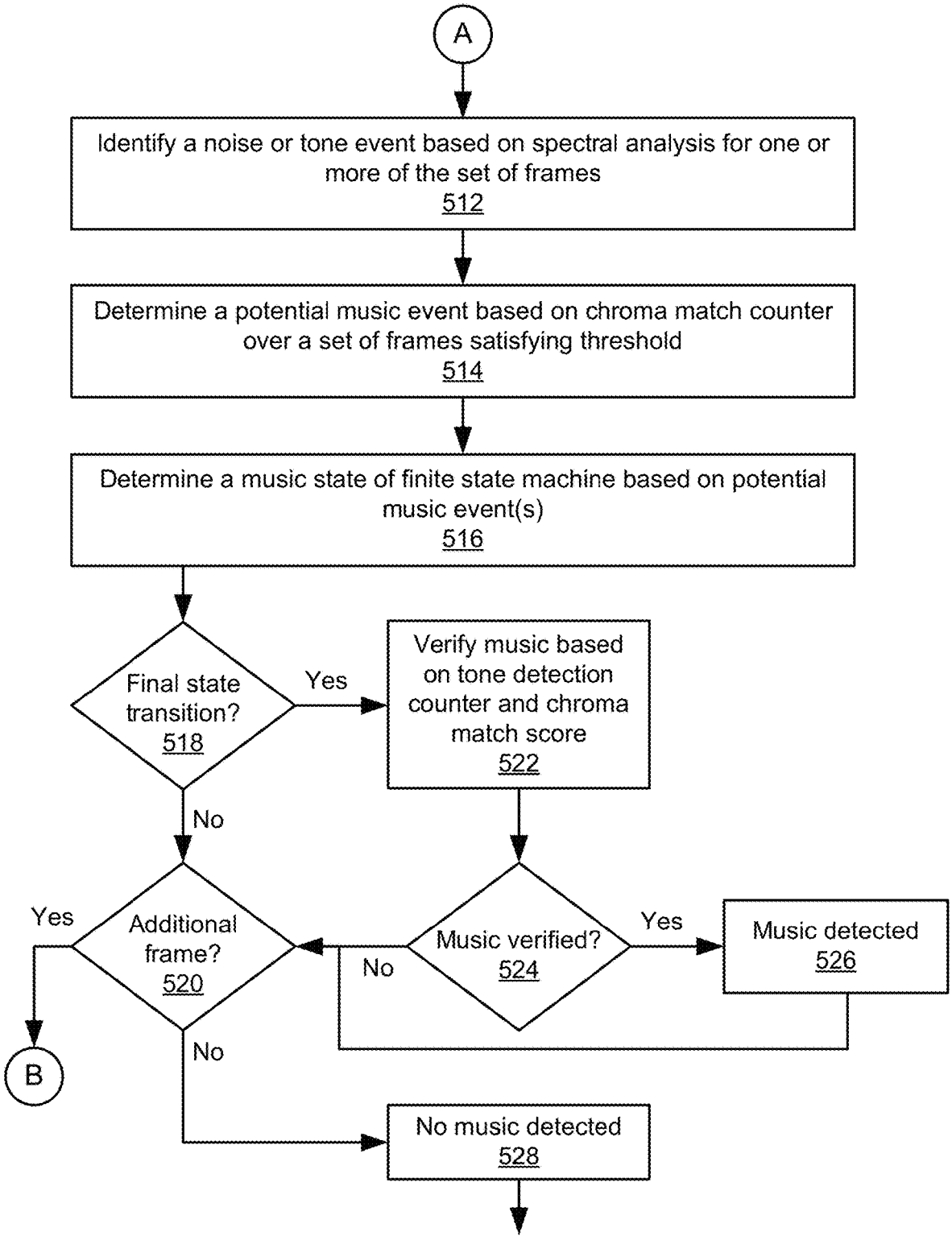

FIGS. 5A and 5B are flowcharts of an example method for detecting music in an audio signal. In some implementations, at 502, the smart music detection module 305 may determine chroma values for frequencies in an audio signal. For example, the smart music detection module 305 may determine one or more frequencies of the audio signal (e.g., using a Fast Fourier Transform, values in the tables in FIG. 8 or 9, etc.).

At 504, the smart music detection module 305 may estimate the energy for each chroma value in one or more frames in the audio signal.

For example, the smart music detection module 305 may calculate LF spectrogram (7) per chroma value in each octave (e.g., the set of octaves 4-7, as described above), based on the table described in FIG. 9.

In some instances, the smart music detection module 305 may determine the signal energy estimate for each chroma value i in the m-th frame:

$$E(m, i) = \alpha E(m-1, i) + (1-\alpha) \sum_{k=B_L(i)}^{B_H(i)} |X(m, k)|^2, \; 0 \le i \le 11, \tag{9}$$

where $\alpha$ is a smoothing factor, $0 \le \alpha < 1$, $B_H(i)$ and $B_L(i)$ are the highest and lowest FFT bins corresponding to chroma value i, respectively. For example, $B_H(3)=81$ and $B_L(3)=78$ for octave 7; $B_H(3)=40$ and $B_L(3)=39$ for octave 6. In some implementations, the smart music detection module 305 may select $\alpha$ from examples: $\alpha=0.55$, $\alpha=0.75$, or $\alpha=0.9$.

In some implementations, the smart music detection module 305 may evaluate an averaged chroma energy per FFT bin in dB domain, which may be defined by the relationship $$E_{dB}(m, i) = 10\log_{10} \frac{E(m, i)}{B_H(i) - B_L(i) + 1}, \; 0 \le i \le 11, \tag{10}$$

where E(m,i) is given by the relationship (9).

In some implementations, the smart music detection module 305 may repeat the computations at (9) and (10) per chroma value in each octave (e.g., in the set of octaves 4-7), based on the table illustrated in FIG. 9. For example, when each chroma value in an octave contains at least one FFT bin, the smart music detection module 305 may calculate E(m,i) and $E_{db}(m,i)$, $0 \le i \le 11$. In some implementations, such as in the wide band case, N=512 may be chosen, where each note in octave 8 has at least one FFT bin. In some instances, the smart music detection module 305 may repeat the computations at (9) and (10) for octave 8. Similarly, all notes in octave 9 are available for evaluation in the full band case with a 24000 Hz bandwidth.

It should be noted that additional or alternative operations for spectral analysis, such as determining the maximum averaged energy in a dB domain, are described in reference to FIG. 6 below.

At 506, the smart music detection module 305 may identify chroma value(s) with maximum energy (also referred to herein as a peak chroma values) in one or more octaves based on the estimate. For instance, the smart music detection module 305 may find the peak note or chroma value with maximum energy in each octave in a linear domain. For example, the spectrogram per chroma value in each octave of octaves 5-7 may be given by the relationship (9), using which the smart music detection module 305 may determine the chroma value with a maximum energy in each octave. In some implementations, identifying the peak chroma value may include sorting the energies for the chroma values (e.g., determined at 504) in each octave and then selecting the chroma value with the highest energy, although other implementations are possible.

At 508, the smart music detection module 305 may set a chroma match score for current frame based on number of octaves with chroma value(s) with the same maximum energy. For instance, the smart music detection module 305 may count octaves that have matching peak chroma values with maximum energy.

For example, among a defined set of octaves (e.g., octaves 5-7), if two octaves or three octaves have the same note with peak energy, the smart music detection module 305 may assign a chroma match score for a current frame. In some instances, as shown in relationship (19) below, the smart music detection module 305 may assign a double match score if three octaves have the same peak chroma value. If no chroma is found, then the smart music detection module 305 may set the chroma match score to zero. As an example, the chroma match score may be defined as follows:

$$match_score = \begin{cases} 8, & \text{if three octaves have the same peak note} \\ 4, & \text{if two octaves have the same peak note} \\ 0, & \text{otherwise} \end{cases} \quad (19)$$

Match scores of four and eight may be chosen in (19) to represent the cases two or three octaves have the same peak chroma value; however, it should be noted that other real numbers may be used without departing from the scope of this disclosure.

Figure 6:
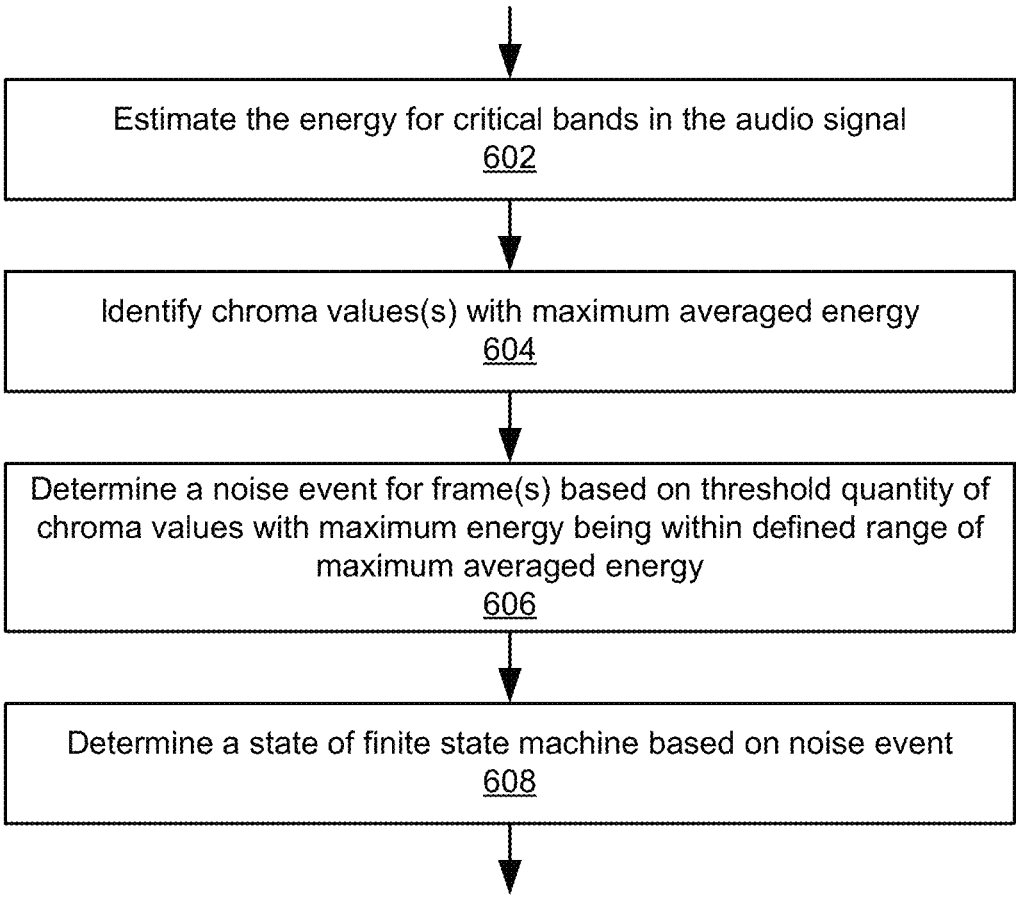
FIG. 6 is a flowchart of an example method for distinguishing a potential music event from noise.

In some implementations, the smart music detection module 305 may perform one or more of the operations described in reference to FIG. 6 when determining the match score at 508, the chroma match counter at 510, or a noise or tone event at 512, although other implementations are possible.

At 510, the smart music detection module 305 may set a chroma match counter value based on number of octaves with chroma value(s) with the same maximum energy. For instance, the chroma match counter value may be determined based on the chroma match score, which may be based on a quantity of the plurality of octaves that include a matching chroma value with maximum energy in the set of frames. For example, if the chroma match score is positive for current frame, the smart music detection module 305 may increase a chroma consecutive match counter by one. In some implementations, if the chroma match score for the frame is zero, the smart music detection module 305 may reset the chroma match counter to zero, although it should be noted that, in other implementations, the smart music detection module 305 may forgo increasing or may decrease the chroma match counter.

In some implementations, at 512, the smart music detection module 305 may identify a noise or tone event based on spectral analysis for one or more of the set of frames. For example, in some instances, before declaring a music event being present, the smart music detection module 305 may exclude noise and tone-like signals from a potential music event by defining pre-requisite conditions for determination of a music event. For example, noise and tone spectrums tend to be relatively flat, so the smart music detection module 305 may declare a noise or tone event, for example based on multiple maxima in an octave (e.g., based on relationship (9)). An example method for identifying a noise or tone event is described in further detail in reference to FIGS. 7A-7C.

At 514, the smart music detection module 305 may determine a potential music event, for example, based on a chroma match counter satisfying threshold. For instance, if the smart music detection module 305 determines that a chroma is identified consistently (e.g., at a threshold percentage) in a set of consecutive frames (e.g., ten frames), then a music event is declared. For example, a peak chroma value may be identified as sufficiently consistent if it shows up in a threshold quantity of frames.

At 516, the smart music detection module 305 may determine music state of finite state machine based on potential music event(s). As discussed above, a finite state machine may include multiple music states to increase the music detection accuracy in the context of music, speech, and noise. For example, a single music event, or multiple music events, form a state, such that determining one or more music states of the audio signal may be based on a quantity of the one or more potential music events that occur within a set of frames.

In some implementations, the smart music detection module 305 may consider two music events to form a music state, although other implementations are possible and contemplated herein. For example, in implementations where the finite state machine includes a total of eight states: $S_0$-$S_7$, the final state $S_7$ may be a music detected state. In some instances, each state in the state $S_0$-$S_6$ may have maximum life length L, for example L=200, 300, or 400 frames. After L frames in a state $S_i$, if the smart music detection module 305 does not detect two music events (or another defined quantity), then it may reset the finite state machine to the initial state $S_0$. However, in some instances, if the smart music detection module 305 detects two music events within L frames, it may move the finite state machine to the next state $S_{i+1}$, $0 \le i \le 6$.

Figure 7A:
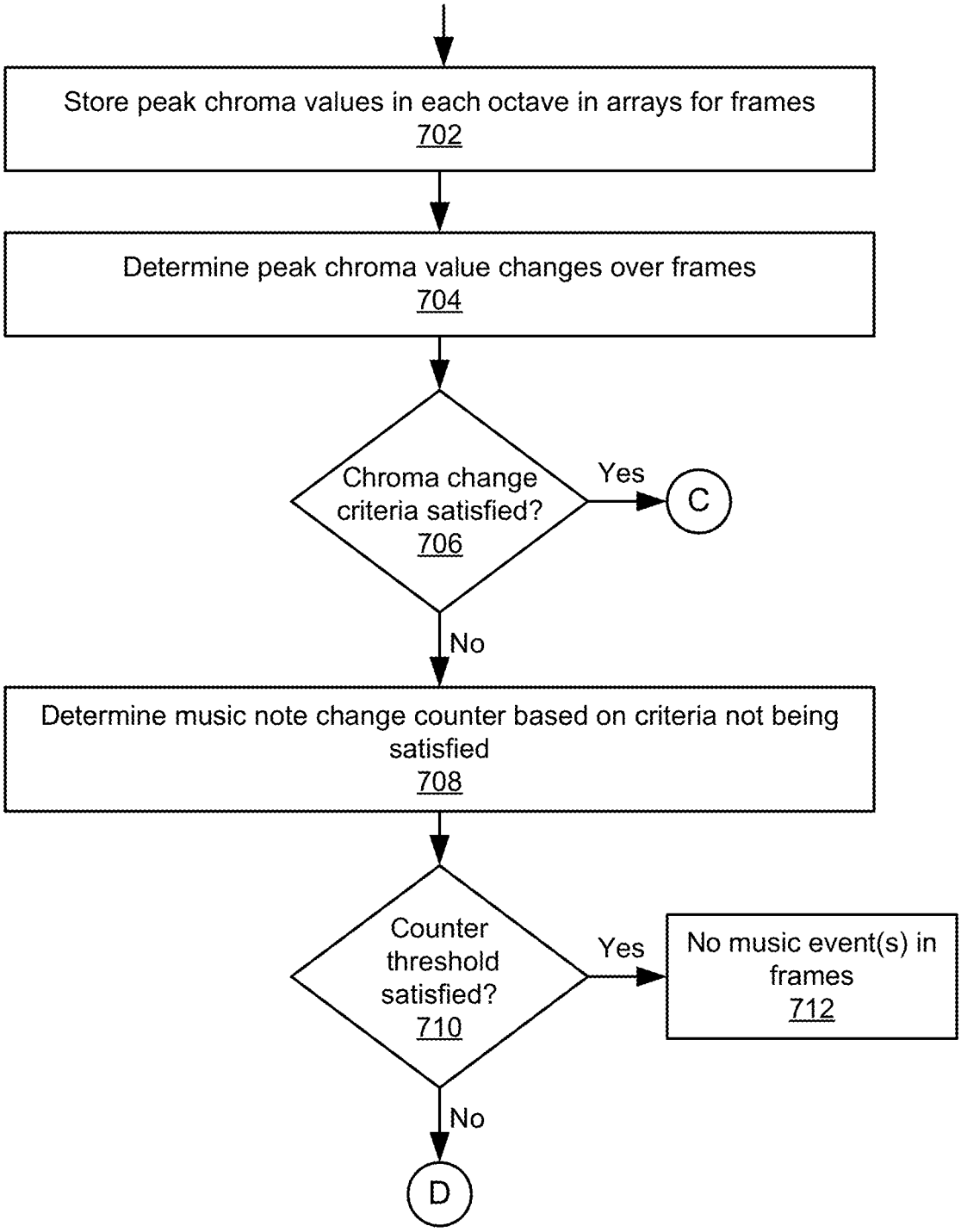
FIGS. 7A-7C are flowcharts of an example method for distinguishing potential music from noise or tones.
Figure 7B:
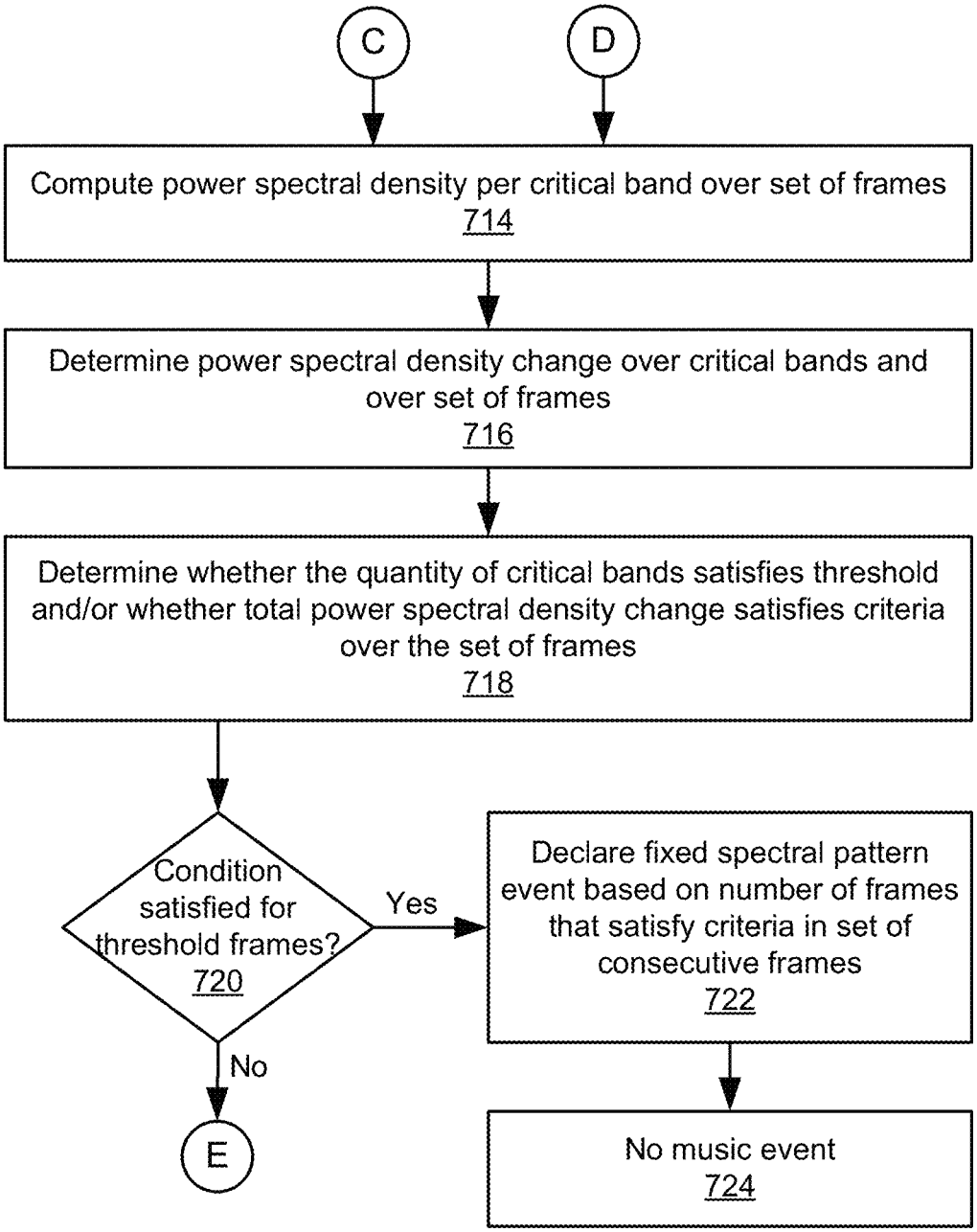
Figure 7C:
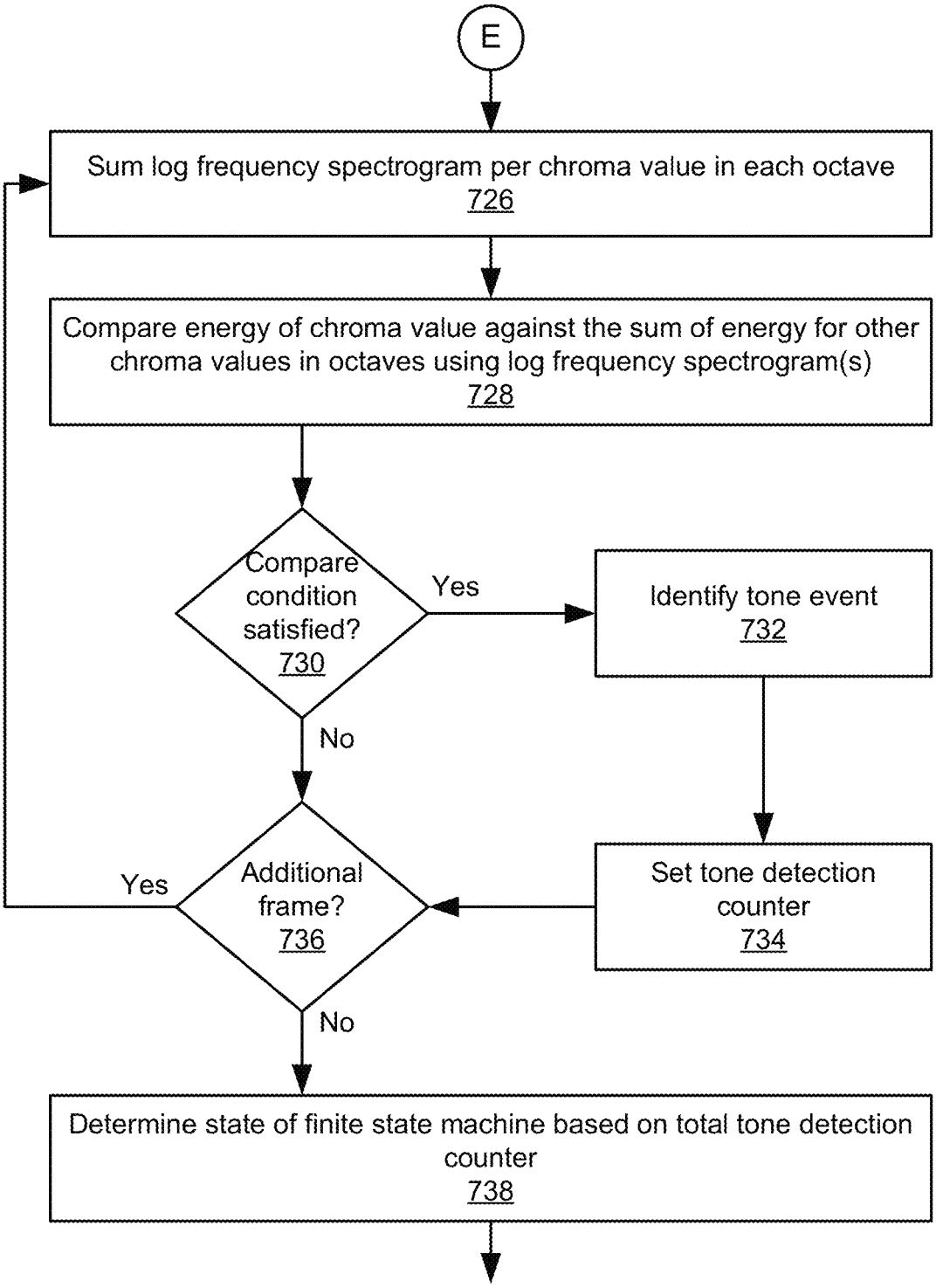

In some implementations, as described in reference to FIGS. 6-7C, if the smart music detection module 305 determines a noise or tone event is present, it may reset the state of the finite state machine to the initial state $S_0$. For example, if the smart music detection module 305 determines that there are more than a defined threshold quantity of chroma values achieving the same maximum energy value (e.g., five), then it may identify the frame as a noise frame and reset the finite state machine to an initial state S or move the state to a previous state.

At 518, the smart music detection module 305 may determine whether the music state of the finite state machine is at a final state transition. In some implementations, a transition between various of the states may include additional or different conditions for the transition. For example, if the finite state machine is at a state $S_6$ (e.g., in the 8 state implementation described above), a transition to a final state may require additional conditions to be met. For instance, if two music events are found when at a state $S_6$, the smart music detection module 305 may determine whether conditions are satisfied, for example, as described in reference to the operation at 522.

In response to determining, at 518, that the music state of the finite state machine is at a final state transition, the smart music detection module 305 may verify, at 522 that any additional criteria for transitioning to the final state are satisfied. For example, the smart music detection module 305 may verify whether the audio signal includes music based on tone detection counter and chroma match score.

As described above, the smart music detection module 305 may accumulate a music note change counter num_note_change: for each music event and finite state machine state. At state $S_6$, if two music events are found, before the smart music detection module 305 declares a final music detection, the smart music detection module 305 may verify whether the following condition is satisfied $$\text{num_note_changes} < \Delta_3, \tag{29}$$

where $\Delta_3$ is a constant (e.g., 20, 30, or 40). In some implementations, the smart music detection module 305 may reset the state to an initial state S in the case of a tone event and a note change counter satisfying or exceeding a threshold. For example, the smart music detection module 305 may determine that there are too many note changes in a short time based on condition (29) not being satisfied, which may indicate that music is not present. In some implementations, based on this determination, the smart music detection module 305 may reset the finite state machine state to an initial state $S_0$.

Additionally, in some implementations, the smart music detection module 305 may accumulate the chroma match score (e.g., defined in (19)) during music events across the finite state machine states. The total match score may be tracked using a variable chroma_match_score. For instance, the smart music detection module 305 may accumulate the chroma match score over plural P consecutive frames and over the states in the finite state machine. Similarly, the smart music detection module 305 may accumulate a tone detection counter num_tone_detect (e.g., described in reference to 732 below) for each music event in the states of the finite state machine.

In some implementations, at state $S_6$, if two music events are found, the smart music detection module 305 may, before declaring a final music detection, verify whether the following conditions are satisfied $$\text{num_tone_detect} \geq \Delta_4, \tag{30}$$

$$\text{chroma_match_score} < \Delta_5, \tag{31}$$

where $\Delta_4$ and $\Delta_5$ are some constants (e.g., $\Delta_4$=15, 25, or 35, and $\Delta_5$=560, 660, or 760). In some implementations, if both (30) and (31) are satisfied simultaneously, then the smart music detection module 305 may determine that a tone event is present and, in some instances, may reset the state to $S_0$.

In some implementations, if one of (30) and (31) are satisfied, the smart music detection module 305 may advance the state to a final state at 524 and 526. For example, at 524, the smart music detection module 305 may determine whether audio signal has verified music and in response to a positive determination, may declare that music is detected at 526. In response to a negative determination at 524, the smart music detection module 305 may declare that the audio signal and/or the set of analyzed frames, do not include music. In some implementations, whether the smart music detection module 305 declares music as present at 526 or not present at 528, the method described in FIGS. 5A and 5B may continue to analyze the audio signal or subsequent set of frames (e.g., as a rolling set or from one grouping of frames to another grouping).

In response to determining, at 518, that the music state of the finite state machine is not a final state, the smart music detection module 305 may determine, at 520, whether the audio data includes another frame to analyze. In response to a positive determination at 520, it may return to the operation 502 for the next frame in the set of frames to be analyzed.

In response to determining, at 520, that the audio signal and/or set of frames of the audio signal does not include additional frames to analyze, the smart music detection module 305 may proceed to 528, where a non-music state may be declared by the smart music detection module 305.

The description herein indicates that a music event may consist of P consecutive frames, Q music events to form a state, and total R states in the finite state machine. The description uses P=10, Q=2, and R=7, but it should be noted that there are many combinations of (P,Q,R) that may be used without departing from the scope of this disclosure and that these values are provided by way of example.

FIG. 6 is a flowchart of an example method for distinguishing a potential music event from noise. In some implementations, the operations of the method described in reference to FIG. 6 may be performed in parallel, before, or using the computations of the method described in reference to FIG. 4-5B or 7A-7C, for example. In some implementations, the smart music detection module 305 may exclude noise and noise like events from potential music events by defining conditions for identifying a music event. For instance, using one or more of the operations of the method in FIG. 6, the smart music detection module 305 may determine multiple maxima in an octave based on the relationship at (9), which may indicate a substantially flat noise spectrum and not a music event.

In some implementations, at 602, the smart music detection module 305 may estimate the energy for critical bands in the audio signal, for example, in a dB domain.

In some implementations, in order to discriminate a music event from speech or noise, the smart music detection module 305 may perform spectral analysis based on critical bands. In the voice spectrum, critical bands may be defined using the Bark scale: 100 Hz, 200 Hz, 300 Hz, 400 Hz, 510 Hz, 630 Hz, 770 Hz, 920 Hz, 1080 Hz, 1270 Hz, 1480 Hz, 1720 Hz, 2000 Hz, 2320 Hz, 2700 Hz, 3150 Hz, 3700 Hz, 4400 Hz, 5300 Hz, 6400 Hz, 7700 Hz, 9500 Hz, 12000 Hz, and 15500 Hz. In the case of narrow band, wide band, and full band, there may be eighteen, twenty-two, twenty-five critical bands, respectively.

The smart music detection module 305 may estimate the signal energy for the i-th critical band using $$E_{cb}(m, i) = \alpha E_{cb}(m-1, i) + (1-\alpha)\frac{1}{CB_H(i) - CB_L(i) + 1}\sum_{k=CB_L(i)}^{CB_H(i)} |X(m, k)|^2, \tag{11}$$

where $0 \leq i < N_c$, a is a smoothing factor, $0 \leq \alpha < 1$, $N_c$ is the number of total critical bands, and $CB_H(i)$ and $CB_L(i)$ are the highest and lowest FFT bins for the i-th critical band, respectively. $N_c$=18, 22, and 25 for the narrow, wide, and full bands, respectively. In some instances, the dB value of the signal spectral energy for the i-th critical band is defined by $$EdB_{cb}(m,i)=10\log_{10}E_{cb}(m,i),\ 0\le i<N_c. \tag{12}$$

The total signal energy in dB based on all critical bands may be given by $$EdB_{total}(m)=\sum_{i=0}^{N_c-1}EdB_{cb}(m,i), \tag{13}$$

for the m-th frame.

At 604, the smart music detection module 305 may identify chroma values(s) with maximum averaged energy, and may determine a noise event for frame(s) based on threshold quantity of chroma values with maximum energy being within defined range of maximum averaged energy, at 606.

In some implementations, the smart music detection module 305 may find the peak note with maximum averaged energy in the dB domain. For example, the smart music detection module 305 may use the formula (10) to determine the chroma value with maximum averaged energy in the dB domain. In some instances, the peak note with maximum averaged energy in the dB domain may coincide with the peak note with maximum energy in the linear domain (e.g., as described in reference to FIG. 5A) when music is present, but there are examples showing that these elements may be different in certain contexts. For example, the context may include that a partial frequency is drifting away from the harmonic frequency with integer multiple of the fundamental frequency; or otherwise due to the polyphonic nature of music.

In some instances, the incoming audio may satisfy a minimum total energy requirement $$EdB_{total}(m)\ge\Delta_1, \tag{14}$$

where $\Delta_1$ is a small constant, e.g., −55 dB, −60 dB, or −65 dB. Within a small dB range (e.g., 1/20 dB, 1/10 dB, or 1/5 dB), the smart music detection module 305 may identify chroma values closing to the maximum averaged energy (e.g., within a defined range) in dB from (10) in each octave. If the total number of identified chroma values within a defined range (e.g., based on (14) above) is bigger than a threshold (e.g., five to ten), then the smart music detection module 305 may determine that the frame is a noise frame, no chroma is present, and may reset the state of the finite state machine to the initial state $S_0$. If chroma is present, the smart music detection module 305 may continue the chroma analysis for the frame.

In some implementations, when evaluating the chroma values with maximum averaged energy per frame, the smart music detection module 305 may calculate the dB values for chroma values in octave 5-7 (e.g., 36 times of logo function calls). In some instances, to save CPU usage, the smart music detection module 305 may create an equivalent linear domain evaluation. In a linear domain, the following inequality of the maximum averaged energy $E_{max}$ and the note energy $E_{note}$:

$$E_{max}-E_{note}\le\gamma_0E_{max}, \tag{15}$$

is equivalent to the following equality in dB domain $$10\log_{10}(E_{\max})-10\log_{10}(E_{note})\le 10\log_{10}\frac{1}{1-\gamma_0}=\Delta_0, \tag{16}$$

where $\gamma_0$ is a constant. From (15) and (16), it follows that $$\gamma_0=1-10^{\Delta_0}. \tag{17}$$

Thus, by choosing $\gamma_0$ as in (17), the dB evaluation in (16) may be replaced by an equivalent linear domain evaluation (15), where $\Delta_0$ is a small dB number (e.g., 1/20 dB, 1/10 dB, or 1/5 dB).

Similar to (14), the maximum averaged energy in dB domain in each octave may be bigger than a constant $$\max_{0\le i\le 11}E_{dB}(m,i)\ge\Delta_2, \tag{18}$$

where $\Delta_2$ is a small constant, for example, −55 dB, −60 dB, or −65 dB. In case that at least one octave among octaves 5-7 does not satisfy (18), then this frame may not satisfy the music event condition.

At 608, the smart music detection module 305 may determine a state of finite state machine based on noise event. For example, as described above, if the smart music detection module 305 detects a noise event, it may reset the state of the finite state machine to an initial state, depending on the implementation.

FIGS. 7A-7C are flowcharts of an example method for distinguishing potential music from noise or tones. For instance, in the method described in FIGS. 7A-7C, the smart music detection module 305 may detect fixed or nearly fixed spectral patterns and, in some instances, may accumulate the detection(s) in a tone detection counter. As described briefly above, because random speech and noise are unlikely to be declared as a music event, the method in FIGS. 7A-7C provides operations for discriminating a potential music event against noise signals with substantially fixed (e.g., flatter than a defined threshold) spectral patterns, such as tones, tone-like noise, sirens, etc.

The chroma match score (19) may be based on the peak chroma value in octaves 5-7 in a current frame, for example. The smart music detection module 305 may also track peak chroma value changes across consecutive frames, because music notes tend to last for a while (e.g., 100 ms-2 seconds), depending on factors, such as tempo and the sheet music. For example, if the FFT frame time is 10 ms then ten frames last 100 ms. Frequent peak note change in consecutive ten frames may indicate that no music event is present, as described in further detail below.

In some implementations, at 702, the smart music detection module 305 may store peak chroma values in each octave and frame in arrays. For example, the smart music detection module 305 may quantify peak chroma values in each octave (e.g., in the set of octaves 5-7) for one or more frames including saving the peak chroma values in arrays peak_note[ ] and peak_pre_note[ ] for the current and previous frames, respectively.

At 704, the smart music detection module 305 may determine peak chroma value changes over frames. For instance, the smart music detection module 305 may use $$D_0=\sum_{i=0}^{2}|peak_note[i]-peak_pre_note[i]| \tag{20}$$

which represents the peak chroma value changes in the previous frames in octaves (e.g., past two frames in octaves 5-7).

At 706, the smart music detection module 305 may determine whether chroma change criteria are satisfied. If the criteria are satisfied, the smart music detection module 305 may proceed to the operation at 714, depending on the implementation. In some implementations, if the criteria are not satisfied, the smart music detection module 305 may proceed to the operation at 708.

In some implementations, the chroma change criteria may include that, for music, i) $D_0$ should be less or equal to a small number (e.g., 3), and that, ii) at least two peak notes in octaves 5-7 remain the same (or a different quantity in a different set of octaves).

At 708, the smart music detection module 305 may determine a value of the music note change counter based on criteria not being satisfied. For instance, the smart music detection module 305 may increase a music note change counter num_note_change: by one if both of the criteria i) and ii) are not satisfied. For example, the smart music detection module 305 may increase the note change counter if, in a set of two consecutive frames, no two peak notes remain the same. In some implementations, the smart music detection module 305 may increase the note change counter if the peak note changes more than a threshold quantity of times At 710, the smart music detection module 305 may determine whether a threshold for the music note change counter has been satisfied. In some implementations, if the music note change counter threshold is satisfied, the smart music detection module 305 may declare that no music event(s) are present in the frames at 712. For example, if in a consecutive ten frames (or other quantity), the music note change counter exceeds or satisfies a defined threshold (e.g., 5, 7, 8, etc.), then music is not present in the past ten frames, the smart music detection module 305 may declare that music is not present, and, in some implementations, may reset the state of the finite state machine to the initial state.

In some implementations, at 714, the smart music detection module 305 may compute power spectral density per critical band over a set of frames, and, at 716, the smart music detection module 305 may determine power spectral density change over the critical bands and over the set of frames.

In some implementations, to find signals with fixed spectral patterns (e.g., noise), the smart music detection module 305 may employ power spectral density per critical band introduced in (11)-(13). For example, the power spectral density change between consecutive frames may be determined as follows:

$$D_1(m,i)=|EdB_{cb}(m,i)-EdB_{cb}(m-1,i),\ 0\le i<N_c. \tag{21}$$

The total power spectral density change over $N_c$ critical bands may be given by $$D_1(m)=\sum_{i=0}^{N_{c-1}} D_1(m,i). \tag{22}$$

Similarly, the power spectral density change between the m-th frame and the (m−2)-th frame may be given by $$D_2(m,i)=|EdB_{cb}(m,i)-EdB_{cb}(m-2,i)|,\ 0\le i<N_c. \tag{23}$$

The total power spectral density change over $N_c$ critical bands between the m-th frame and the (m−2)-th frame may be given by $$D_2(m)=\sum_{i=0}^{N_{c-1}} D_2(m,i) \tag{24}$$

At 718, the smart music detection module 305 may determine whether the quantity of critical bands satisfies threshold and/or whether total power spectral density change satisfies criteria over the set of frames.

For example, the smart music detection module 305 may check how many critical bands satisfy $$D_1(m,i)\le\delta_1,\ 0\le i<N_c, \tag{25}$$

where $\delta_1$ is a small constant (e.g., ⅕ dB or 1/10 dB). The smart music detection module 305 may additionally or alternatively check the total power spectral density change/difference $$D_1(m)\le\delta_2, \tag{26}$$

where $\delta_2$ is a small constant (e.g., ½ dB or ⅓ dB).

At 720, the smart music detection module 305 may determine whether the condition is satisfied for a threshold quantity of frames. In some implementations, if the condition is satisfied, the smart music detection module 305 may proceed to the operation at 722, where the smart music detection module 305 may declare that the analyzed set of frames include a fixed spectral pattern event, such as a noise or tone event, based on number of frames that satisfy criteria in a set of frames (e.g., consecutive frames).

For example, if the total quantity of critical bands satisfying (25) is bigger than a threshold (e.g., 13), or the total power spectral density change satisfies (26), then the smart music detection module 305 may increase the critical band match counter num_cb_match by one. Similarly, the smart music detection module 305 may compare the power spectral density changes between the m-th frame and the (m−2)-th frame, defined by (23) and (24), against the thresholds S and 4, respectively.

In some implementations, if num_cb_match is increased at least eight times in consecutive ten frames (or another quantity in a different set of frames), the smart music detection module 305 may determine (e.g., based on the power spectral density not changing in consecutive frames) that noise with a fixed spectral pattern is present. In such an instance, the smart music detection module 305 may determine that the analyzed set of frames do not include a music event at 724.

In some implementations, at 726, the smart music detection module 305 may sum log frequency spectrogram per chroma value in each octave, and, at 728, the smart music detection module 305 may compare energy of a chroma value against the sum of energy for the other chroma values in octaves using the log frequency spectrogram(s).

For example, the smart music detection module 305 may also differentiate a tone event from a music event. The smart music detection module 305 may sum up the LF spectrogram per chroma value (9) in each octave of a set (e.g., octaves 4-7). In some instances, the smart music detection module 305 may then sum up the total note energy for the 44 notes for octaves 4-7 as shown in the table in FIG. 9, which may be defined as $E_{total}(m)$. In some instances, the maximum note energy among the 36 notes in octaves 5-7 may be denoted by $E_{max}(m)$, and it may be supposed that $E_{max}(m)$ corresponds to note i*. i* has two other neighbor notes (i−1)* and (i+1)*, assuming a modulo 12 operation. If i* is the last note in octave 7, then i* has only one neighbor note (i−1)*. Let $E_{other}(m)$ denote the remaining note energy from $E_{total}(m)$ minus that of i* and its two other neighbor notes:

$$E_{other}(m)=E_{total}(m)-E(m,(i-1)^*)-E(m,i^*)-E(m,(i+1)^*). \quad (27)$$

In some instances, a tone event may be determined based on one note energy being bigger than the sum of the other notes. Since music may also have harmonics, a music event is different from tone event. For example, the smart music detection module 305 may identify a tone event using the following criterion $$E_{max}(m)\geq\gamma_1 E_{other}(m), \quad (28)$$

where $\gamma_1$ is a constant (e.g., 2, 3, or 6).

At 730, the smart music detection module 305 may determine whether the compare condition is satisfied (e.g., using the criterion at (28)). In response to determining that the compare condition is satisfied at 730, the smart music detection module 305 may proceed to the operation at 732, where it may identify a tone event in the audio signal.

At 734, the smart music detection module 305 may set a value for the tone detection counter, for example, based on a quantity of chroma value changes over a defined time period. For instance, if the condition (28) is satisfied, then the smart music detection module 305 may increase the tone detection counter num_tone_detect by one. The smart music detection module 305 may accumulate the tone detection counter across tone events in the finite state machine.

In response to determining that the compare condition is satisfied at 730, the smart music detection module 305 may proceed to the operation at 736, where it may determine whether there is another frame in a set of frames and/or the audio signal to analyze for music. If there is another frame or set of frames to analyze, the method may proceed at 726 or another operation. In some instances, in addition to processing a subsequent frame or if processing a given set of frames has completed, the method may continue to 738.

At 738, the smart music detection module 305 may determine a state of finite state machine based on a total tone detection counter value and/or the one or more music states. For example, in some implementations, as described above, the smart music detection module 305 may declare that the audio signal includes music based on a transition of the one or more music states to a final state in a finite state machine. In some implementations, the transition of the one or more music states to the final state in the finite state machine may be based on a tone detection counter value satisfying a threshold accumulated over a set frames, for example, as described in reference to 522-526 above.

As will be understood by those familiar with the art, the invention may be embodied in other specific forms without departing from the spirit or essential characteristics thereof. Likewise, the particular naming and division of the portions, modules, agents, managers, components, functions, procedures, actions, layers, features, attributes, methodologies, data structures, and other aspects are not mandatory, and the mechanisms that implement the invention or its features may have different names, divisions and/or formats. The foregoing description, for purpose of explanation, has been described with reference to specific examples. However, the illustrative discussions above are not intended to be exhaustive or limiting to the precise forms disclosed. Many modifications and variations are possible in view of the above teachings. The examples were chosen and described in order to best explain relevant principles and their practical applications, to thereby enable others skilled in the art to best utilize various examples with or without various modifications as may be suited to the particular use contemplated.

What is claimed is:

1. A computer-implemented method, comprising:

receiving, by a computing device, audio data describing an audio signal;

determining, by the computing device, a set of frames of the audio signal using the audio data;

identifying, by the computing device, one or more potential music events based on a spectral analysis of the set of frames satisfying a chroma value condition;

performing, by the computing device, a spectral analysis test to exclude false positives from the one or more potential music events based on Identifying non-music events having spectral characteristics corresponding to noise, tones or tone-like signals;

determining, by the computing device, a first music state of a finite state machine based on the one or more potential music events of the audio signal;

determining, by the computing device, a transition from the first music state to a final music state of the finite state machine based on the one or more potential music events; and declaring, by the computing device, that the audio signal includes music based on the transition of the finite state machine to the final music state wherein the state machine progresses through a series of states to confirm that the chroma value condition is satisfied over at least a pre-selected threshold number of the set of frames.

2. The computer-implemented method of claim 1, wherein performing the spectral analysis test comprises implementing a tone detection algorithm to detect at least one of a spectral flatness and a fixed spectral pattern.

3. The computer-implemented method of claim 1, wherein tones and tone-like signals are identified in the set of frames by the spectral analysis test based on a spectral flatness constraint.

4. The computer-implemented method of claim 1, wherein noise signals are identified in the set of frames by the spectral analysis test based on a fixed spectral pattern condition.

5. The computer-implemented method of claim 4, wherein a spectral flatness constraint comprises a spectral pattern being flatter than a preselected threshold.

6. The computer-implemented method of claim 4, wherein a spectral flatness constraint comprises a power spectral density change threshold over a selected number of frames.

7. The computer implemented method of claim 4, wherein a spectral flatness constraint comprises a threshold number of maxima in an octave.

8. The computer-implemented method of claim 4, further comprising identifying a tone or a tone-like signal by using a tone detection counter.

9. The computer-implemented method of claim 1, wherein the chroma value condition comprises:

determining a chroma match counter value based on a quantity of a plurality of octaves that includes the matching chroma value with the maximum energy in the set of frames; and determining a potential music event based on the chroma match counter value.

10. A computer-implemented method, comprising:

receiving, by a computing device, audio data describing an audio signal;

determining, by the computing device, a set of frames of the audio signal using the audio data;

identifying, by the computing device, one or more potential music events based on a spectral analysis of the set of frames satisfying a peak chroma value condition associated with music;

detecting whether the one or more potential music events have spectral characteristics of non-music events corresponding to noise, tone signals, or tone-like signals; and determining, by the computing device, actual music events by differentiating the one or more potential music events from non-music events.

11. The computer-implemented method of claim 10, wherein the determining actual music events further comprises using a state machine to advance through a sequence of states to verify that the peak chroma value condition is satisfied over a pre-selected fraction of frames of the set of frames.

12. The computer-implemented method of claim 11, wherein the determining actual music events further comprises resetting the state machine in response to the detection of a non-music event.

13. The computer-implemented method of claim 10, wherein the peak chroma value condition comprises:

determining a chroma match counter value based on a quantity of a plurality of octaves that includes the matching chroma value with the maximum energy in the set of frames; and determining a potential music event based on the chroma match counter value.

14. The computer-implemented method of claim 10, wherein tones and tone-like signals are identified in the set of frames based on a spectral flatness constraint.

15. The computer-implemented method of claim 14, wherein the spectral flatness constraint comprises a spectral pattern being flatter than a preselected threshold.

16. The computer-implemented method of claim 14, wherein the spectral flatness constraint comprises a power spectral density change threshold over a selected number of frames.

17. The computer-implemented method of claim 14, wherein the spectral flatness constraint comprises a threshold number of maxima in an octave.

18. The computer-implemented method of claim 10, wherein noise signals are identified in the set of frames based on fixed spectral pattern condition.

19. A computer-implemented method, comprising:

receiving, by a computing device, audio data describing an audio signal;

determining, by the computing device, a set of frames of the audio signal using the audio data;

performing, by the computing device, a spectral analysis of the set of frames; and determining, by the computing device, one or more music states of the audio signal based on a pre-selected threshold number of the frames of the set of frames satisfying a peak chroma value condition of a quantity of octaves having a given chroma value with a maximum energy.

20. The computer-implemented method of claim 19 wherein the pre-selected threshold number of the set of frames corresponds to a threshold number of frames of the set of frames selected to distinguish music from non-music with a chosen minimum accuracy.

21. The computer-implemented method of claim 19, wherein the peak chroma value condition comprises:

determining one or more chroma values for frequencies in the audio signal;

estimating an energy for each of the one or more chroma values;

identifying a chroma value of the one or more chroma values with a maximum energy in each of a plurality of octaves based on the estimated energy for the one or more chroma values; and determining the quantity of the plurality of octaves that include a matching chroma value with the maximum energy, the matching chroma value being the given chroma value.

22. The computer-implemented method of claim 19, wherein the peak chroma value condition comprises:

tracking, by the computing device, peak chroma changes over one or more frames of the set of frames based on energies of the peak chroma values in the one or more frames; and declaring, by the computing device, a nonmusical event based on a quantity of peak chroma changes over the one or more frames.

23. The computer-implemented method of claim 19, wherein the determining one or more music states further comprises eliminating false positive determinations of music events by performing a tone event detection algorithm to differentiate a music event from a non-music event having spectral characteristics corresponding to noise, a tone signal, or a tone-like signal.

24. The computer-implemented method of claim 23, wherein tones and tone-like signals are identified in the set of frames by a spectral analysis test based on a spectral flatness constraint.

25. The computer-implemented method of claim 24, wherein the spectral flatness constraint comprises a spectral pattern being flatter than a preselected threshold.

26. The computer-implemented method of claim 24, wherein the spectral flatness constraint comprises a power spectral density change threshold over a selected number of frames.

27. The computer-implemented method of claim 24, wherein the spectral flatness constraint comprises a threshold number of maxima in an octave.

28. The computer-implemented method of claim 23, wherein noise signals are identified in the set of frames by a spectral analysis test based on a fixed spectral pattern condition.

29. A computer-implemented method, comprising:

receiving, by a computing device, audio data describing an audio signal;

determining, by the computing device, a set of frames of the audio signal using the audio data;

performing, by the computing device, a spectral analysis of the set of frames;

determining, by the computing device, one or more potential music events of the audio signal based on a condition that a pre-selected number of the set of frames satisfy a peak chroma value condition associated with music, with the pre-selected number chosen to distinguish music events from non-music events; and eliminating false positives from the one or more potential music events by analyzing the one or more potential music events for spectral characteristics indicative of noise, a tone signal, or a tone-like signal.

30. The computer-implemented method of claim 29, wherein the spectral characteristics include at least one of a spectral flatness and a fixed spectral pattern.

* * * * *